US007274273B2

(12) United States Patent
Hirose et al.

(10) Patent No.: US 7,274,273 B2
(45) Date of Patent: Sep. 25, 2007

(54) DIELECTRIC RESONATOR DEVICE, DIELECTRIC FILTER, DUPLEXER, AND HIGH-FREQUENCY COMMUNICATION APPARATUS

(75) Inventors: Keiichi Hirose, Sagamihara (JP); Shigeyuki Mikami, Yokohama (JP); Yutaka Sasaki, Nagaokakyo (JP); Toshiro Hiratsuka, Machida (JP)

(73) Assignee: Murata Manufacturing Co., Ltd. (JP)

( * ) Notice: Subject to any disclaimer, the term of this patent is extended or adjusted under 35 U.S.C. 154(b) by 178 days.

(21) Appl. No.: 10/543,376

(22) PCT Filed: Mar. 1, 2004

(86) PCT No.: PCT/JP2004/002469

§ 371 (c)(1),
(2), (4) Date: Jul. 26, 2005

(87) PCT Pub. No.: WO2004/079857

PCT Pub. Date: Sep. 16, 2004

(65) Prior Publication Data

US 2006/0152302 A1 Jul. 13, 2006

(30) Foreign Application Priority Data

Mar. 4, 2003 (JP) ..... 2003-057695

(51) Int. Cl.
*H01P 5/12* (2006.01)
*H01P 1/20* (2006.01)
*H01P 7/10* (2006.01)

(52) U.S. Cl. ..... 333/134; 333/202; 333/208; 333/219.1

(58) Field of Classification Search ..... 333/134, 333/202, 204, 208, 219, 219.1
See application file for complete search history.

(56) References Cited

U.S. PATENT DOCUMENTS

| | | | | |
|---|---|---|---|---|
| 3,443,131 | A * | 5/1969 | Oltman, Jr. | 310/321 |
| 3,566,315 | A * | 2/1971 | Vinding | 333/204 |
| 3,868,694 | A * | 2/1975 | Meinke | 343/753 |
| 4,423,397 | A | 12/1983 | Nishikawa et al. | |
| 6,014,575 | A * | 1/2000 | Miura | 505/210 |
| 6,184,758 | B1 * | 2/2001 | Ishikawa et al. | 333/134 |
| 6,331,808 | B2 * | 12/2001 | Mikami et al. | 333/134 |
| 2004/0021531 | A1 * | 2/2004 | Mukaiyama et al. | 333/202 |

FOREIGN PATENT DOCUMENTS

| | | |
|---|---|---|
| JP | H11-004108 | 1/1999 |
| JP | 2000-013106 | 1/2000 |
| JP | 2002-100911 | 4/2002 |
| JP | 2002-124808 | 4/2002 |

OTHER PUBLICATIONS

The International Search Report PCT/ISA/210 Form with English Language Translation and the PCT/ISA/237 Form with English Language Translation filed for the Parent PCT Application.

* cited by examiner

*Primary Examiner*—Robert Pascal
*Assistant Examiner*—Kimberly E. Glenn
(74) *Attorney, Agent, or Firm*—Dickstein, Shapiro, LLP.

(57) ABSTRACT

Electrodes (2) and (3) are formed on the front face (1A) and the rear face (1B) of a dielectric substrate (1). Fan-shaped apertures (4A) and (4B) forming a resonator (4) are formed in the electrodes (2) and (3) such that the fan-shaped aperture (4A) opposes the fan-shaped aperture (4B). Accordingly, two parameters, that is, the radius and the central angle, of the fan-shaped apertures (4A) and (4B) can be used to set the resonant frequency of the resonator (4), thus improving the flexibility in design of the resonator (4).

22 Claims, 32 Drawing Sheets

DIELECTRIC RESONATOR DEVICE, DIELECTRIC FILTER, DUPLEXER, AND HIGH-FREQUENCY COMMUNICATION APPARATUS

TECHNICAL FIELD

The present invention relates to a dielectric resonator device, a dielectric filter, a duplexer, and a high-frequency communication apparatus, which are preferably used for high-frequency electromagnetic waves (high-frequency signals), including microwaves and extremely high-frequency waves.

BACKGROUND ART

The first related arts in which electrodes formed of conducting films are provided on the front face and the rear face of a dielectric substrate, is the generally known planar dielectric transmission line resonators (hereinafter referred to as the PDTL resonators) are formed in the electrodes on the both faces, and the PDTL resonators are each composed of rectangular apertures opposite to each other with the dielectric substrate being sandwiched therebetween (for example, Japanese Unexamined Patent Application Publication No. 11-4108). In such first related arts, adjoining two-stage resonators are formed on the same substrate and the resonators are coupled to each other to form a dielectric filter.

The second related known arts is which three or more stages of resonators (for example, PDTL resonators or TE010-mode resonators) are arranged in a line on the same substrate and the adjoining resonators are coupled to each other to form a dielectric filter (for example, Japanese Unexamined Patent Application Publication No. 2000-13106). In such second related arts, a coupled polarization line for directly coupling (hereinafter referred to as jump-coupling) the resonators, which are one or more stages away from each other, is provided in a casing covering the dielectric substrate or on the electrodes on the dielectric substrate to form attenuation peaks at both the high-frequency side and the low-frequency side of the passband.

In the above first related arts, for example, rectangular apertures are used to constitute the PDTL resonator in a dielectric resonator device. When the thickness, the permittivity, and the size of the cavity of the dielectric substrate are constant, the resonant frequency is determined by the length of the resonators. Since the length of the resonators is uniquely determined in accordance with the resonant frequency, an unloaded Q factor or spurious characteristics are determined only by the width of the resonators, thus decreasing the flexibility in design of the resonators.

In the above second related arts, the electrical length of the coupled polarization line for forming the attenuation peak is set to 180° or more. Accordingly, the spurious resonance of the coupled line for polarization can appear near the passband to deteriorate the attenuation characteristics.

In addition, since the level of the jump-coupling varies with variation in the distance between the coupled line for polarization and the resonators or in the electrical length of the coupled line for polarization, there is a problem in that the frequency of the attenuation peak is varied due to the positional shift or variation in size of the coupled line for polarization to destabilize the attenuation characteristics.

Furthermore, when the coupled line for polarization is formed on the same substrate as the resonators in order to lessen the influence of the positional shift or the like of the coupled line for polarization, it is necessary to sufficiently decrease the level of coupling between the coupled line for polarization and another resonator (for example, the second-stage resonator) although the coupled line for polarization is coupled to the resonators (for example, the first-stage and third-stage resonators) that are to be jump-coupled to each other. Hence, there is a problem in that the dielectric substrate tends to increase in size.

DISCLOSURE OF INVENTION

In order to resolve the above problems, it is a first object of the present invention to provide a dielectric resonator device capable of increasing the flexibility in design of the resonators.

It is a second object of the present invention to provide a dielectric filter capable of improving the spurious characteristics to stabilize the attenuation characteristics and reduce the size of the overall apparatus and to provide a duplexer and a high-frequency communication apparatus using the dielectric filter.

According to a first aspect, the present invention provides a dielectric resonator device including a dielectric substrate made of a dielectric material, an electrode provided on at least the front face of the dielectric substrate, among both faces of the dielectric substrate, and an aperture that is formed in the electrode and that forms a resonator. The aperture of the resonator is a fanned-out aperture which has two sides forming a central angle with respect to an apex on the fringe, which is fanned out with respect to the apex, and in which an arc line of electric force appears between the two sides.

With this structure, the fanned-out aperture resonates under the condition that when considering the apex as the center, both the inner-diameter side and the outer-diameter side of the fanned-out aperture are short ends and the intermediate position in a radial direction is an open end. At this time, since the fanned-out aperture functions similarly to, for example, a half-wavelength resonator in accordance with the radial dimension of the fan-shaped aperture, the resonant frequency varies with the radial dimension of the fanned-out aperture. Since the fan-shaped aperture is fanned out more with distance from the apex, a sparse distribution of the magnetic field tends to occur at the outer fringe side while a dense distribution of the magnetic field tends to occur at the inner side. Hence, the resonant frequency also varies with the central angle of the fan-shaped aperture since the distribution of the magnetic field of the inner-diameter side greatly varies when the central angle of the fan-shaped aperture is varied. As a result, the two parameters, that is, the radial dimension and the central angle, of the fanned-out aperture can be used to set the resonant frequency, so that it is possible to increase the flexibility in design of the resonator.

The fanned-out aperture may be a fan-shaped aperture set by cutting out a resonator composed of, for example, a circular aperture along a radial line extending from the center, may be an arc aperture set by cutting out a resonator composed of a ring-shaped (doughnut-shaped) aperture along two radial lines extending from the center, or may be a triangle aperture.

According to the present invention, at least one corner of the fanned-out aperture has a chamfer making the corner round.

With this structure, the chamfer can alleviate the concentration of current flowing along the fringe of the fanned-out aperture at the corners of the fanned-out aperture, so that the unloaded Q factor can be increased.

According to the present invention, an electrode is provided on the rear face of the dielectric substrate, and the electrode on the rear face has an aperture that opposes the fanned-out aperture and that has approximately the same shape as the fanned-out aperture.

With this structure, the fan-shaped apertures provided in the front face and the rear face of the dielectric substrate can be used to set the resonant frequency and, therefore, the flexibility in design of the resonator can be improved, compared with the case in which the fan-shaped aperture is provided only in the front face of the dielectric substrate. In addition, since current flowing along the fringes of the fan-shaped apertures can be dispersed to both the front face and the rear face of the dielectric substrate, the unloaded Q factor can be increased compared with the case in which the fan-shaped aperture is provided only in the front face of the dielectric substrate.

According to the present invention, one or more lines of electric force appear in the fanned-out aperture. With this structure, it is possible to constitute a resonator resonating in a single mode or in multiple modes (a high-order mode).

According to a second aspect, the present invention provides a dielectric filter including a dielectric substrate made of a dielectric material, an electrode provided on at least the front face of the dielectric substrate, among both faces of the dielectric substrate, and a plurality of resonators that are composed of a plurality of apertures formed in the electrode and that are coupled to each other. At least one aperture among the apertures of the plurality of resonators is a fanned-out aperture, which has two sides forming a predetermined central angle with respect to an apex, which sides are fanned out with respect to the apex, and in which an arc line of electric force appears between the two sides.

With this structure, the resonant frequency varies with the radial dimension of the fanned-out aperture since the fanned-out aperture functions similarly to, for example, a half-wavelength resonator in accordance with the radial dimension of the fan-shaped aperture. Since a dense distribution of the magnetic field tends to occur at the inner side of the fanned-out aperture, varying the central angle of the fanned-out aperture can greatly vary the distribution of the magnetic field at the inner side to vary the resonant frequency. As a result, the two parameters, that is, the radial dimension and the central angle, of the fanned-out aperture can be used to set the resonant frequency, so that it is possible to increase the flexibility in design of the resonator and the dielectric filter.

According to the present invention, at least one corner of the fanned-out aperture has a chamfer making the corner round.

With this structure, the chamfer can alleviate concentration of current flowing along the fringe of the fanned-out aperture at the corners of the fanned-out aperture, so that the unloaded Q factor can be increased and the radiation loss in the dielectric filter can be reduced.

According to the present invention, an electrode is provided on the rear face of the dielectric substrate, and the electrode on the rear face has an aperture that opposes the fanned-out aperture and that has approximately the same shape as the fanned-out aperture.

With this structure, the fan-shaped apertures provided in the front face and the rear face of the dielectric substrate can be used to set the resonant frequency and, therefore, the flexibility in design of the resonator and the dielectric filter can be improved, compared with the case in which the fan-shaped aperture is provided only in the front face of the dielectric substrate. In addition, since current flowing along the fringes of the fan-shaped apertures can be dispersed to both the front face and the rear face of the dielectric substrate, compared with the case in which the fan-shaped aperture is provided only in the front face of the dielectric substrate, the unloaded Q factor can be increased and the radiation loss in the dielectric filter can be reduced.

According to the present invention, one or more lines of electric force appear in the fanned-out aperture. With this structure, it is possible to use a resonator resonating in a single mode or in multiple modes (a high-order mode) to constitute the dielectric filter.

According to the present invention, the line of electric force in the fanned-out aperture and the line of electric force in an aperture adjacent to the fanned-out aperture appear opposite to each other among the apertures of the plurality of resonators.

With this structure, the resonator composed of the fanned-out apertures can be magnetically coupled to the adjoining resonator. Although current spreads out in the extending direction of the line of electric force in areas around the apertures of the resonator in the electrode, each aperture of the resonators can be arranged toward the direction in which the current would spread out because the apertures of the adjoining resonators are arranged such that the lines of electric force appear opposite to each other. As a result, it is possible to suppress the spread of the current.

According to the present invention, at least one aperture among the apertures of the plurality of resonators, excluding the fanned-out apertures, is rectangular.

With this structure, the resonator composed of, for example, the rectangular aperture can be coupled to the resonator composed of the fanned-out aperture to constitute a bandpass filter.

According to the present invention, the lines of electric force appear in parallel to each other in the apertures of the plurality of resonators, excluding the fanned-out apertures.

With this structure, the plurality of resonators can be arranged such that the lines of electric force thereof appear in parallel to each other, so that the plurality of resonators can be magnetically coupled to each other.

According to the present invention, all the apertures of the plurality of resonators are fanned-out apertures arranged in an arc.

With this structure, since the adjoining fanned-out apertures can be arranged such that the lines of electric force thereof appear opposite to each other, the adjoining resonators can be magnetically coupled to each other. Since the resonators, which are one stage or more away from each other, can be symmetrically arranged, these resonators, which are one stage or more away from each other, can be jump-coupled to each other to cause the attenuation pole to appear at the high-frequency or low-frequency side of the passband of, for example, a bandpass filter. Since the fanned-out apertures of the plurality of resonators are arranged in an arc, for example, in a substantially C-shaped arc, current can be trapped in the area covering all the plurality of resonators, thus suppressing the spread of the current. As a result, the dielectric filter and peripheral devices can be reduced in size and the packing density of them can be increased.

According to the present invention, the apertures of the input-side and output-side resonators, among the plurality of resonators, are the fanned-out apertures, and the apertures of the remaining resonator is rectangular and are provided between the fanned-out aperture at the input side and the fanned-out aperture at the output side.

With this structure, the fanned-out aperture at the input side and the rectangular aperture can be arranged such that the lines of electric force thereof appear opposite to each other, thus magnetically coupling the fanned-out aperture at the input side to the rectangular aperture. In addition, the fanned-out aperture at the output side and the rectangular aperture can be arranged such that the lines of electric force thereof appear opposite to each other, thus magnetically coupling the fanned-out aperture at the output side to the rectangular aperture. Hence, signals can be propagated from the resonator at the input side to the resonator at the output side through at least one intermediate resonator composed of the rectangular aperture to form, for example, a bandpass filter.

The fanned-out aperture at the input side and the fanned-out aperture at the output side can be arranged with the rectangular aperture sandwiched therebetween such that fanned-out aperture at the input side is fanned out in the direction opposite to that of the fanned-out aperture at the output side. Accordingly, current can be trapped between the fanned-out aperture at the input side and the fanned-out aperture at the output side, thus suppressing the spread of the current.

According to the present invention, the plurality of resonators composed of the rectangular apertures are provided between the fanned-out aperture at the input side and the fanned-out aperture at the output side, and the lines of electric force thereof appear in parallel to each other in the rectangular apertures of the plurality of resonators.

With this structure, the adjoining resonators each composed of the rectangular aperture can be magnetically coupled to each other. Since the fanned-out aperture at the input side and each rectangular aperture can be arranged such that the lines of electric force thereof appear opposite to each other, the resonator at the input side can be magnetically coupled to the plurality of intermediate resonators. In addition, since the fanned-out aperture at the output side and each rectangular aperture can be arranged such that the lines of electric force thereof appear opposite to each other, the resonator at the output side can be magnetically coupled to the plurality of intermediate resonators. Hence, signals can be propagated from the resonator at the input side to the resonator at the output side through the plurality of intermediate resonators magnetically coupled to each other to form, for example, a bandpass filter.

The resonator at the input side can be magnetically coupled to the resonator which is composed of the rectangular aperture and which is one or more stages away from the resonator at the input side, and the resonator at the output side can be magnetically coupled to the resonator which is composed of the rectangular aperture and which is one or more stages away from the resonator at the output side. Accordingly, since jump-coupling with resonator at the output side, in addition to the jump-coupling with the resonator at the input side, can be realized, the attenuation pole can appear at the high-frequency or low-frequency side of the passband of, for example, the bandpass filter owing to the jump-coupling.

According to the present invention, the apertures of the input-side and output-side resonators, among the plurality of resonators, are rectangular apertures, and the aperture of the remaining resonator is the fanned-out apertures that is arranged adjacent to the rectangular apertures at the input side and the rectangular apertures at the output side.

With this structure, the rectangular aperture at the input side and the fanned-out aperture can be arranged such that the lines of electric force thereof appear opposite to each other, thus magnetically coupling the rectangular aperture at the input side to the fanned-out aperture. In addition, the rectangular aperture at the output side and the fanned-out aperture can be arranged such that the lines of electric force thereof appear opposite to each other, thus magnetically coupling the rectangular aperture at the output side to the fanned-out aperture. Hence, signals can be propagated from the resonator at the input side to the resonator at the output side through the intermediate resonator composed of the fanned-out apertures to form, for example, a bandpass filter.

According to the present invention, the rectangular aperture at the input side and the rectangular aperture at the output side are arranged such that the lines of electric force thereof are parallel to each other.

With this structure, the resonator at the input side can be magnetically coupled to the resonator at the output side to jump-couple the resonator at the input side to the resonator at the output side, so that the attenuation pole can appear at the high-frequency or low-frequency side of the passband of, for example, of the bandpass filter.

According to the present invention, the apertures of the input-side and output-side resonators, among the plurality of resonators, are the fanned-out apertures, and the remaining resonator is capable of resonating in a dual-mode, a dual-mode resonator, that is arranged between the fanned-out aperture at the input side and the fanned-out aperture at the output side.

With this structure, the line of electric force in one mode in the dual-mode resonator can appear opposite to the lines of electric force in the input-side and output-side resonators, and the line of electric force in the other mode in the dual-mode resonator can appear opposite to the lines of electric force in the input-side and output-side resonators. Hence, signals can be propagated from the resonator at the input side to the resonator at the output side through the dual-mode resonator to form, for example, a bandpass filter.

In addition, the resonator at the input side can be magnetically coupled to the dual-mode resonator in the two modes, and the resonator at the output side can also be magnetically coupled to the dual-mode resonator in the two modes. Hence, the resonator at the input side can jump the dual-mode resonator in one mode to be jump-coupled to the dual-mode resonator in the other mode, and the resonator at the output side can also jump the dual-mode resonator in the other mode to be jump-coupled to the dual-mode resonator in the one mode. As a result, the attenuation pole can appear at the high-frequency or low-frequency side of the passband of, for example, the bandpass filter owing to the jump-coupling.

Furthermore, the fanned-out aperture at the input side and the fanned-out aperture at the output side can be arranged with the aperture of the dual-mode resonator sandwiched therebetween such that fanned-out aperture at the input side is fanned out in the direction opposite to that of the fanned-out aperture at the output side. Accordingly, current can be trapped between the fanned-out aperture at the input side and the fanned-out aperture at the output side, thus suppressing the spread of the current.

According to the present invention, the dielectric substrate is housed in a casing having two conductive faces isolated from the respective faces of the dielectric substrate.

With this structure, the distance between the conductive faces and the corresponding electrodes on the dielectric substrate can be set to a value sufficient to attenuate a signal having the resonant frequency of the resonator. Hence, electromagnetic waves are not propagated in spaces between the conductive faces and the corresponding electrodes and energy can be trapped around the resonator to reduce the radiation loss in the resonator and to suppress the reduction in the unloaded Q factor.

The dielectric filter according to the present invention may be used to constitute a duplexer or a high-frequency communication apparatus.

With such a structure, the duplexer or the high-frequency communication apparatus can be reduced in size and the level of isolation can be increased.

BEST MODE FOR CARRYING OUT THE INVENTION

A dielectric resonator device, a dielectric filter, a duplexer, and a high-frequency communication apparatus according to embodiments of the present invention will be described in detail below with reference to the attached drawings.

Figure 1:
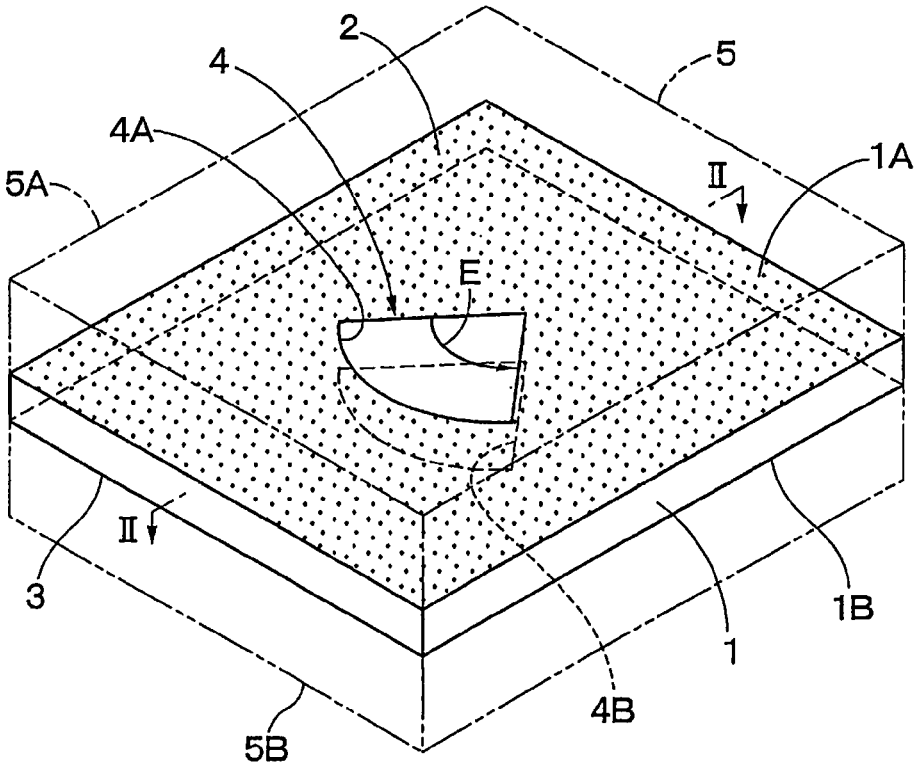
FIG. 1 is a perspective view of a dielectric resonator device according to a first embodiment.
Figure 2:
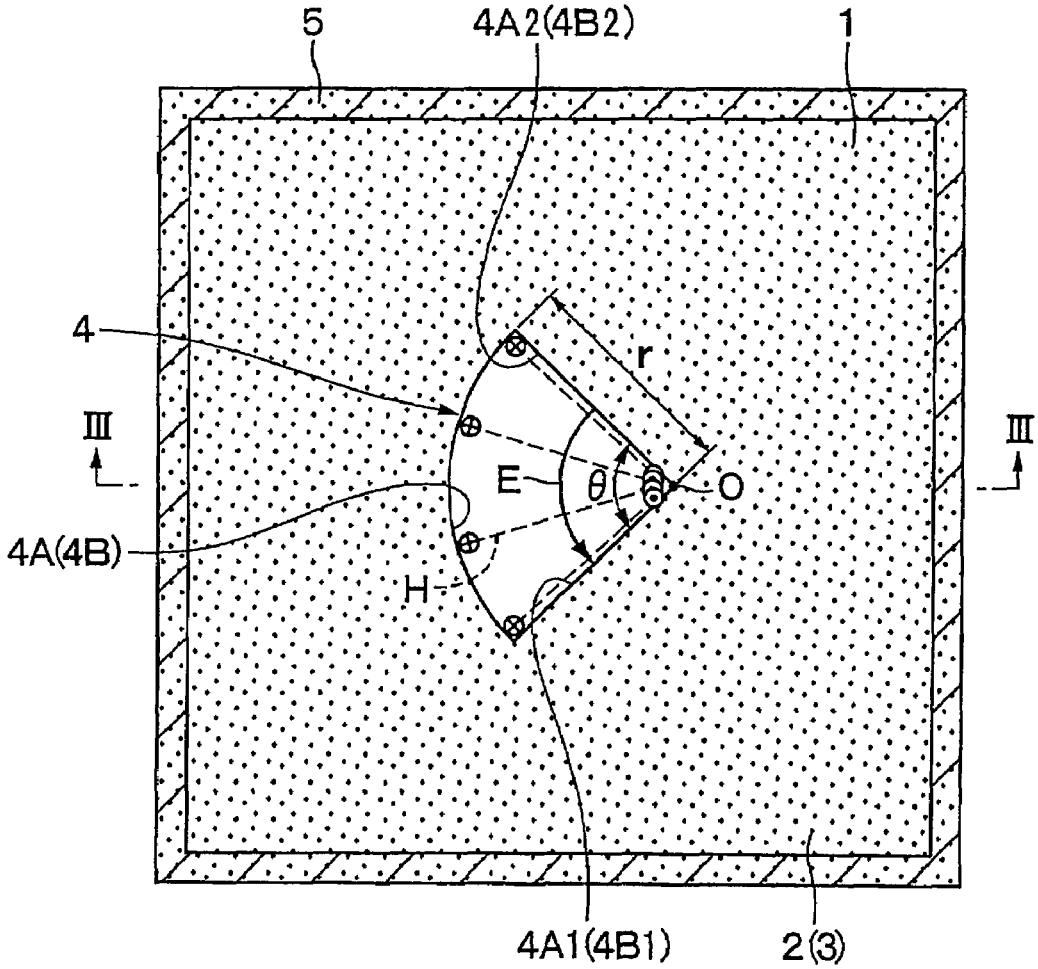
FIG. 2 is a cross-sectional view of the dielectric resonator device taken along line II-II in FIG. 1.
Figure 3:
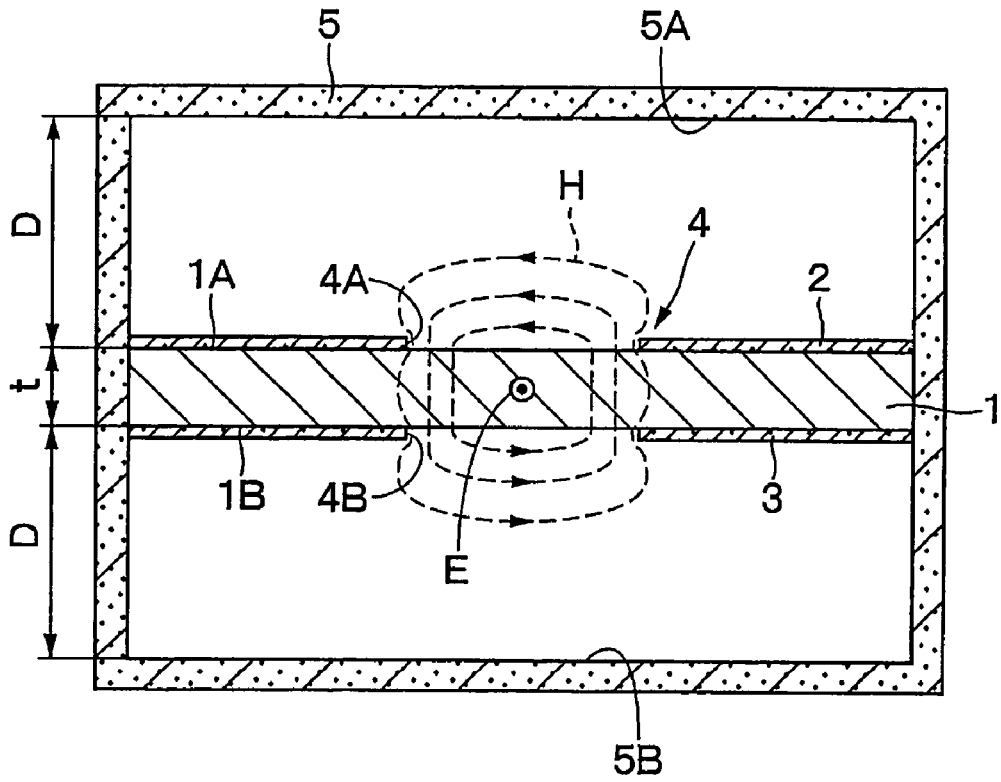
FIG. 3 is a cross-sectional view of a resonator taken along line III-III in FIG. 2.

FIGS. 1 to 3 show a dielectric resonator device according to a first embodiment. Referring to FIGS. 1 to 3, reference numeral 1 denotes a substantially-rectangular and planar dielectric substrate. The dielectric substrate 1 is made of, for example, a resin material, a ceramic material, or a composite material in which the resin material is mixed with the ceramic material and the mixed material is sintered.

Reference numeral 2 denotes an electrode formed on a front face 1A of the dielectric substrate 1 and reference numeral 3 denotes an electrode formed on a rear face 1B thereof. The electrodes 2 and 3 are formed by high-precision patterning of conductive metallic thin films made of gold, copper, silver, or the like on both sides by using, for example, photolithography.

Reference numeral 4 denotes a fan-shaped resonator provided in the center of the dielectric substrate 1. The resonator 4 is composed of fan-shaped apertures 4A and 4B, which are fanned-out apertures formed in the electrodes 2 and 3, respectively. The fan-shaped apertures 4A and 4B each have a radius r and a central angle θ. The fan-shaped aperture 4A opposes the fan-shaped aperture 4B with the dielectric substrate 1 sandwiched therebetween.

The fan-shaped aperture 4A has two sides 4A1 and 4A2 on its fringe. The side 4A1 forms the central angle θ with the side 4A2 with respect to the central point O (apex). The fan-shaped aperture 4A is fanned out with respect to the central point O. Similarly, the fan-shaped aperture 4B has two sides 4B1 and 4B2 on its fringe. The side 4B1 forms the central angle θ with the side 4B2 with respect to the central point O (apex). The fan-shaped aperture 4B has approximately the same shape as the fan-shaped aperture 4A.

The resonator 4 has a resonant frequency f0, for example, of the order of several tens of gigahertz. The resonator 4 has, for example, slot lines, planar dielectric lines, or coplanar lines (not shown) connected thereto and is excited via the lines.

Reference numeral 5 denotes a conductor casing covering the dielectric substrate 1. The conductor casing 5 is made of a conductive metallic material and is formed in a hollow box, as shown in FIGS. 1 to 3. The dielectric substrate 1 is housed in the conductor casing 5 and is fixed at a vertically intermediate position of the conductor casing 5. The conductor casing 5 has a conductor face 5A apart from the front face 1A of the dielectric substrate 1 by a distance D and has a conductor face 5B apart from the rear face 1B of the dielectric substrate 1 by the distance D. The distance D is set to a value sufficient to attenuate a signal having a resonant frequency f0 and is set such that, for example, the cutoff frequency is higher than the resonant frequency f0. This setting prevents electromagnetic waves from being propagated in spaces between the conductor face 5A and the electrode 2 and between the conductor face 5B and the electrode 3. Accordingly, energy can be locked in the fan-shaped apertures 4A and 4B to reduce the radiation loss in the resonator 4 and to suppress the reduction in an unloaded Q factor.

The operation of the dielectric resonator device having the above structure, according to the first embodiment, will be described below with reference to FIGS. 1 to 9.

First, a high-frequency electromagnetic wave (high-frequency signal) of the order of several tens of gigahertz is supplied through various lines. At this time, the central point O of the resonator 4 is short-circuited with the arc on the outer fringe of the resonator 4 and, therefore, the radial intermediate position is disconnected. As a result, the resonator 4 resonates with an arc electric field E (line E of electric force) and an annular magnetic field H, in a cross-sectional view, surrounding the electric field E being formed (refer to FIG. 2).

Since the resonator 4 functions similarly to a half-wavelength resonator in accordance with the radius r of the fan-shaped apertures 4A and 4B, the resonant frequency f0 varies with the radius r. Since the fan-shaped apertures 4A and 4B fan out with respect to the central point O, a sparse distribution of the magnetic field tends to occur at the outer fringe while a dense distribution of the magnetic field tends to occur along the inner sides (near the central point O). Hence, since the distribution of the magnetic field along the inner sides greatly varies when the central angle θ of the fan-shaped apertures 4A and 4B is varied, the resonant frequency f0 also varies with the central angle θ of the fan-shaped apertures 4A and 4B.

Figure 4:
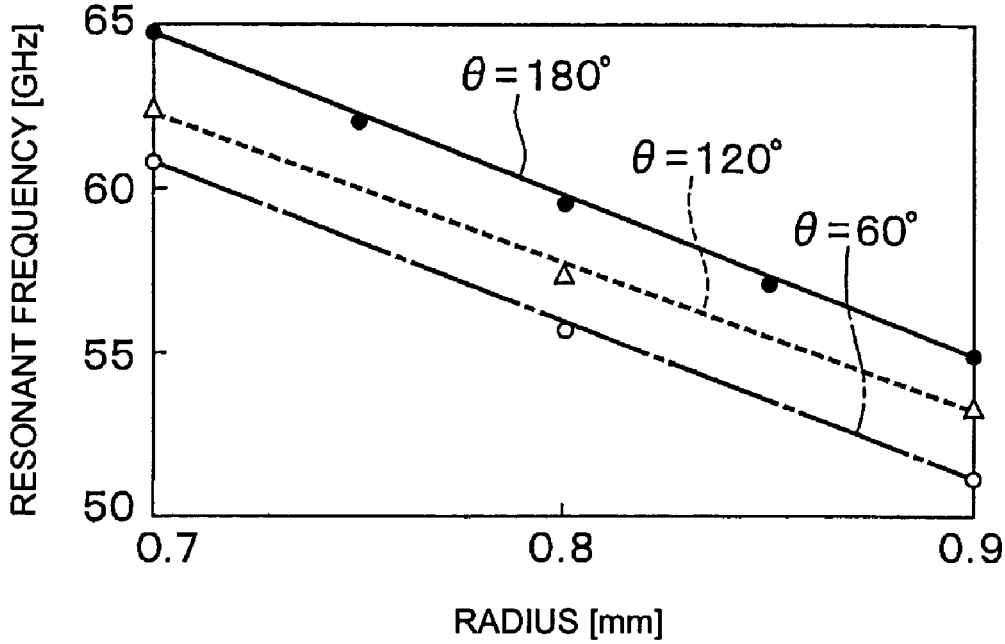
FIG. 4 is a diagram of characteristic lines, showing the relationship between the radius and the resonant frequency when the resonator according to the first embodiment is used.

The relationship between the central angle θ, the radius r, and the resonant frequency f0 was analyzed by using an electromagnetic-field simulator. The results of this analysis are shown in FIG. 4. For example, the relative permittivity ∈r of the dielectric substrate 1 is set to 24 and the thickness t of the dielectric substrate 1 is set to 0.3 mm. FIG. 4 shows that the resonant frequency f0 is decreased as the radius r is increased and the resonant frequency f0 is increased as the central angle θ is increased.

Figure 5:
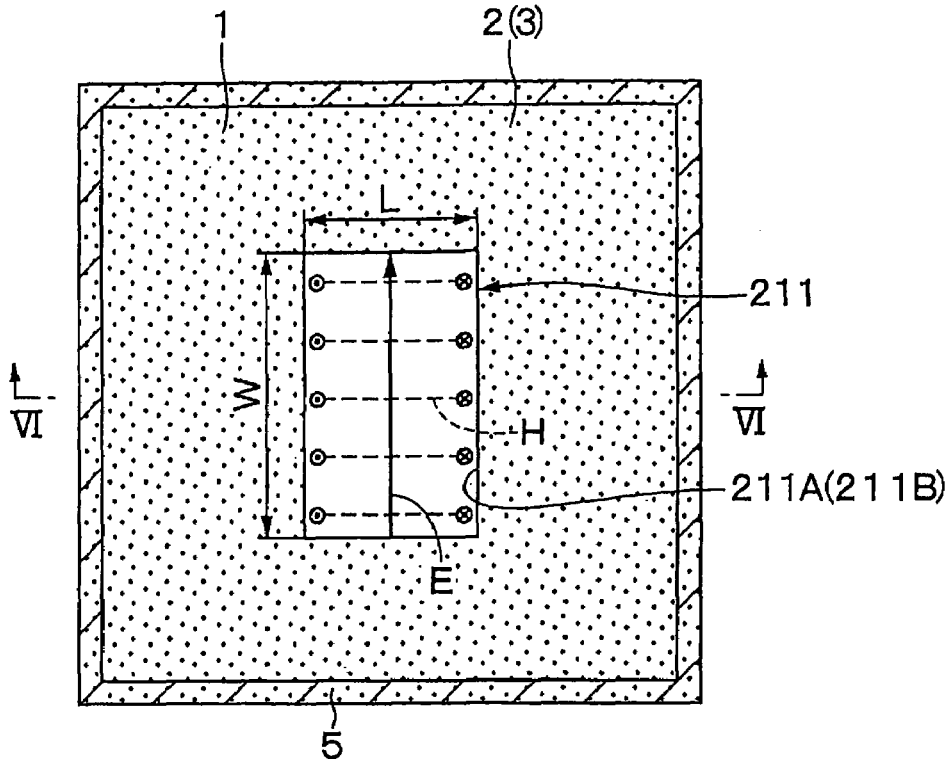
FIG. 5 is a cross-sectional view of a dielectric resonator device in a comparative example, viewed from the same direction as in FIG. 2.
Figure 6:
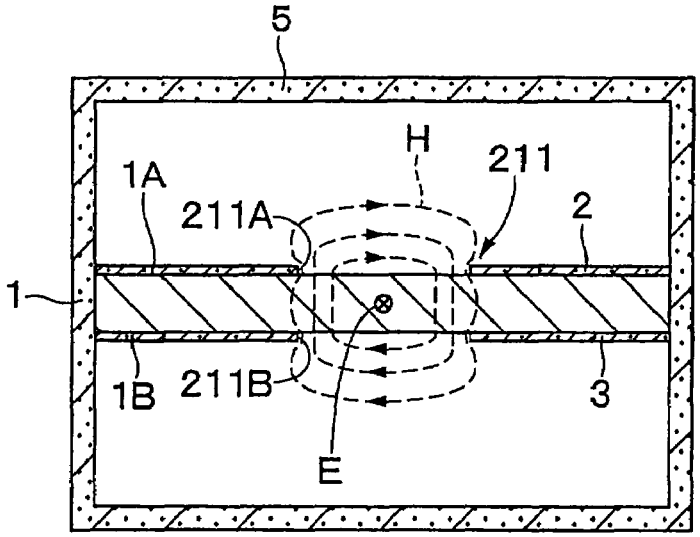
FIG. 6 is a cross-sectional view of a resonator in the comparative example, taken along line VI-VI in FIG. 5.
Figure 7:
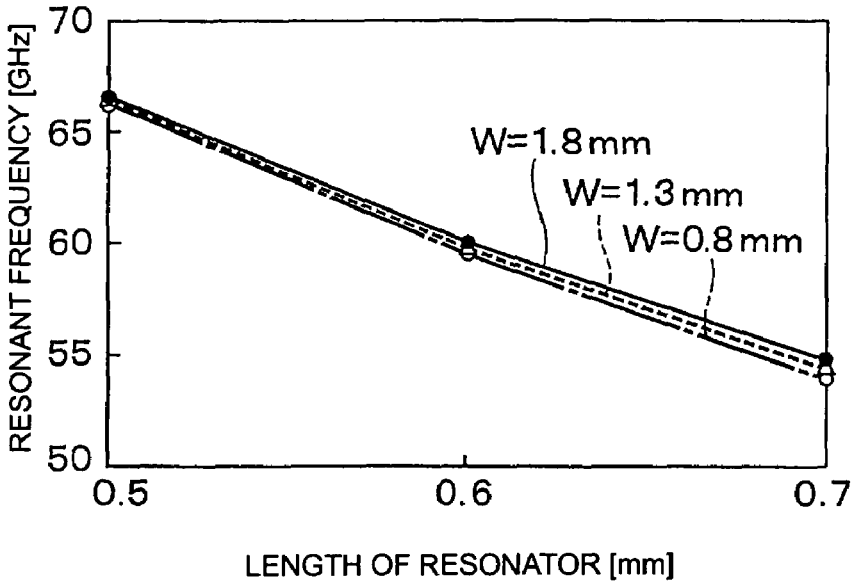
FIG. 7 is a diagram of characteristic lines, showing the relationship between the length of the resonator and the resonant frequency when the resonator in the comparative example is used.

FIGS. 5 and 6 show a comparative example in which rectangular apertures 211A and 211B are provided in the electrodes 2 and 3, respectively, of the dielectric substrate 1 and the rectangular aperture 211A opposes the rectangular aperture 211B to form a planar dielectric transmission line resonator 211 (hereinafter referred to as PDTL resonator 211). The relationship between the length L of the resonator, the width W of the resonator, and the resonant frequency f0 was analyzed by using the electromagnetic-field simulator in this comparative example. The results of this analysis are shown in FIG. 7. FIG. 7 shows that the resonant frequency f0 hardly varies in the PDTL resonator 211 even when the width W of the resonator is varied and the resonant frequency f0 is determined only by the length L of the resonator.

The above analyses show that, since the resonant frequency f0 can be set by using the two parameters, that is, the radius r and the central angle θ of the fan-shaped apertures 4A and 4B, in the dielectric resonator device according to the first embodiment, the flexibility in design of the resonator 4 can be improved, compared with the PDTL resonator 211.

Figure 8:
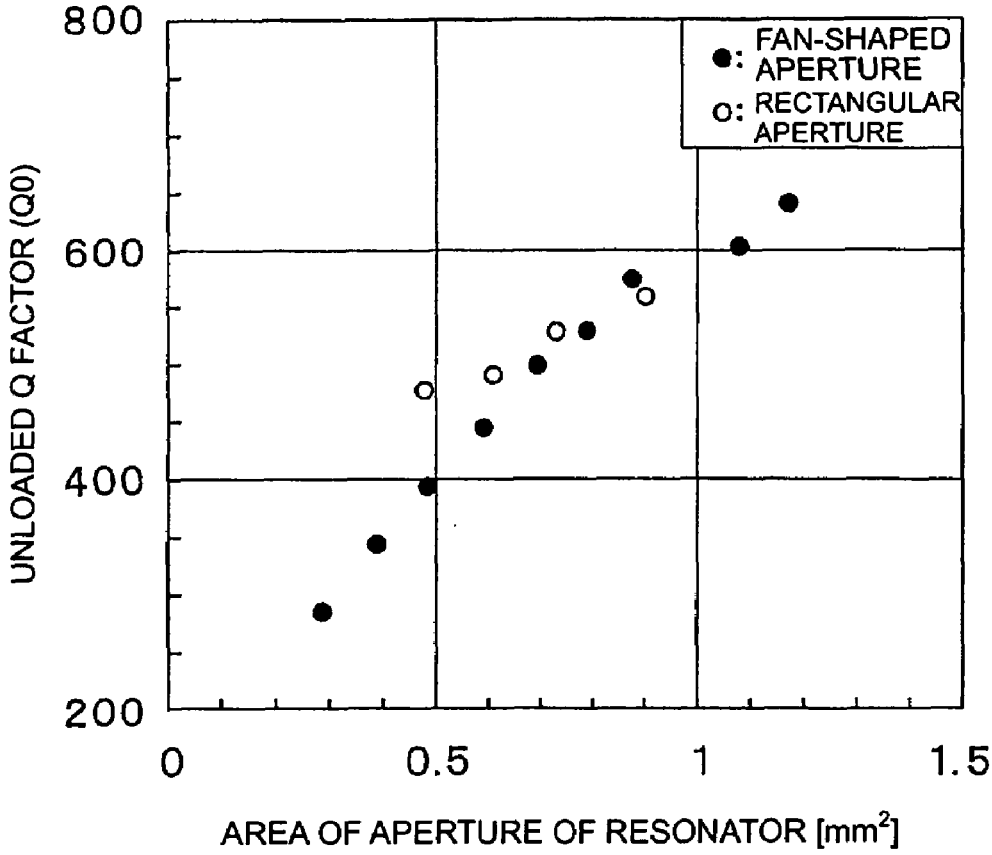
FIG. 8 is a graph illustrating the relationship between the area of the aperture of the resonator and an unloaded Q factor.
Figure 9:
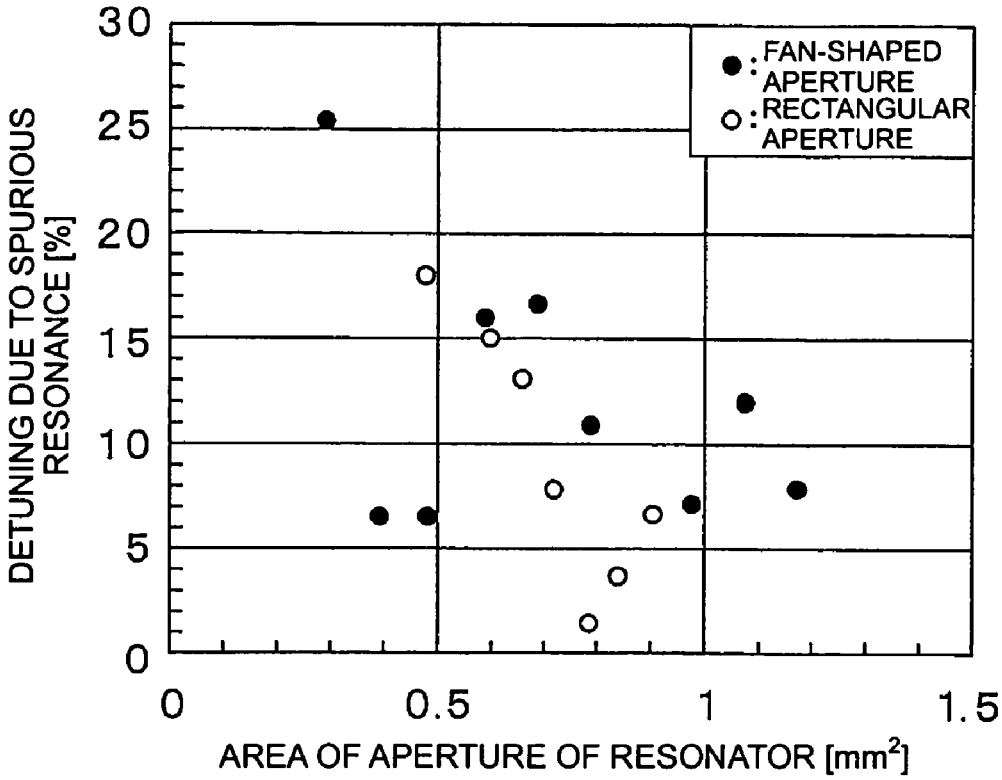
FIG. 9 is a graph illustrating the relationship between the area of the aperture of the resonator and the detuning due to spurious resonance.

The relationship between the areas of the fan-shaped apertures 4A and 4B and the rectangular apertures 211A and 211B and the unloaded Q factor (Q0) and the relationship between the areas thereof and the detuning due to spurious resonance in resonator 4 and PDTL resonator 211, were analyzed by using the electromagnetic-field simulator. The results of there analyses are shown in FIGS. 8 and 9. These analyses show that the resonator 4 composed of the fan-shaped apertures 4A and 4B has approximately the same unloaded Q factor and detuning due to the spurious resonance as the PDTL resonator 211 composed of rectangular apertures 211A and 211B.

Since the fan-shaped apertures 4A and 4B of the resonator 4 have two sides 4A1 and 4A2, side 4A1 forms the central angle θ with side 4A2 with respect to the central point O, and an arc line E of electric force appears between the two sides 4A1 and 4A2 and the arc line E of electric force also appears between the two sides 4B1 and 4B2 according to the first embodiment, the magnetic field H can be concentrated along the inner sides (near the central points O) of the fan-shaped apertures 4A and 4B. Accordingly, the two parameters, that is, the radius r and the central angle θ of the fan-shaped apertures 4A and 4B can be used to set the resonant frequency f0. As a result, the number of combinations of structural parameters of the resonator 4 can be increased when the unloaded Q factor and the spurious characteristics of the resonator 4 are to be determined, thus improving the flexibility in design of the resonator 4.

Since the fan-shaped aperture 4B having approximately the same shape as the fan-shaped aperture 4A is provided in the electrode 3 on the rear face 1B of the dielectric substrate 1 so as to oppose the fan-shaped aperture 4A in the front face 1A, the fan-shaped apertures 4A and 4B provided in the front face 1A and the rear face 1B, respectively, of the dielectric substrate 1 can be used to set the resonant frequency f0 and, therefore, the flexibility in design of the resonator 4 can be improved, compared with the case in which the fan-shaped aperture 4A is provided only in the front face 1A of the dielectric substrate 1. In addition, since current flowing along the fringes of the fan-shaped apertures 4A and 4B can be dispersed to both the front face 1A and the rear face 1B of the dielectric substrate 1, compared with the case in which the fan-shaped aperture 4A is provided only in the front face 1A of the dielectric substrate 1, the unloaded Q factor can be increased.

Figure 10:
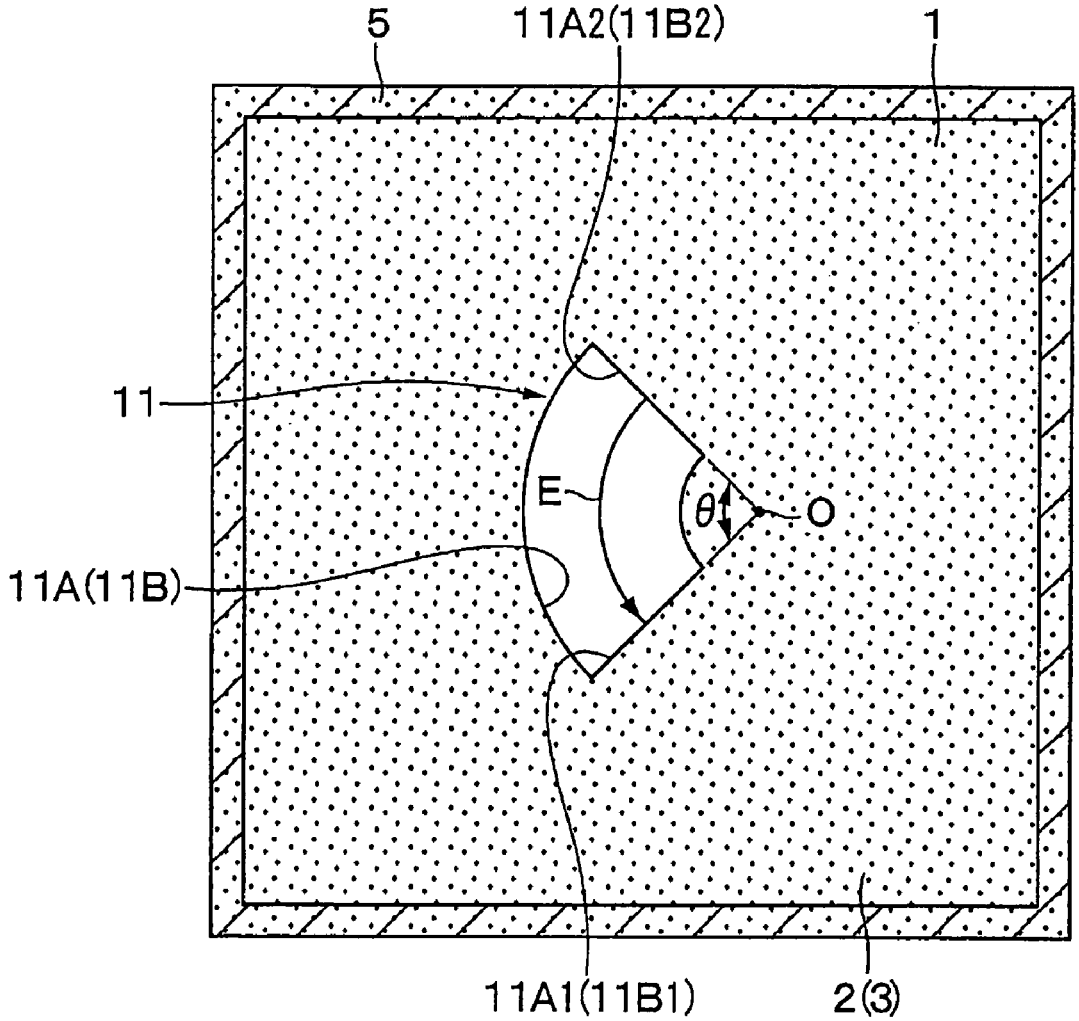
FIG. 10 is a cross-section view of a dielectric resonator device according to a first modification, viewed from the same direction as in FIG. 2.
Figure 11:
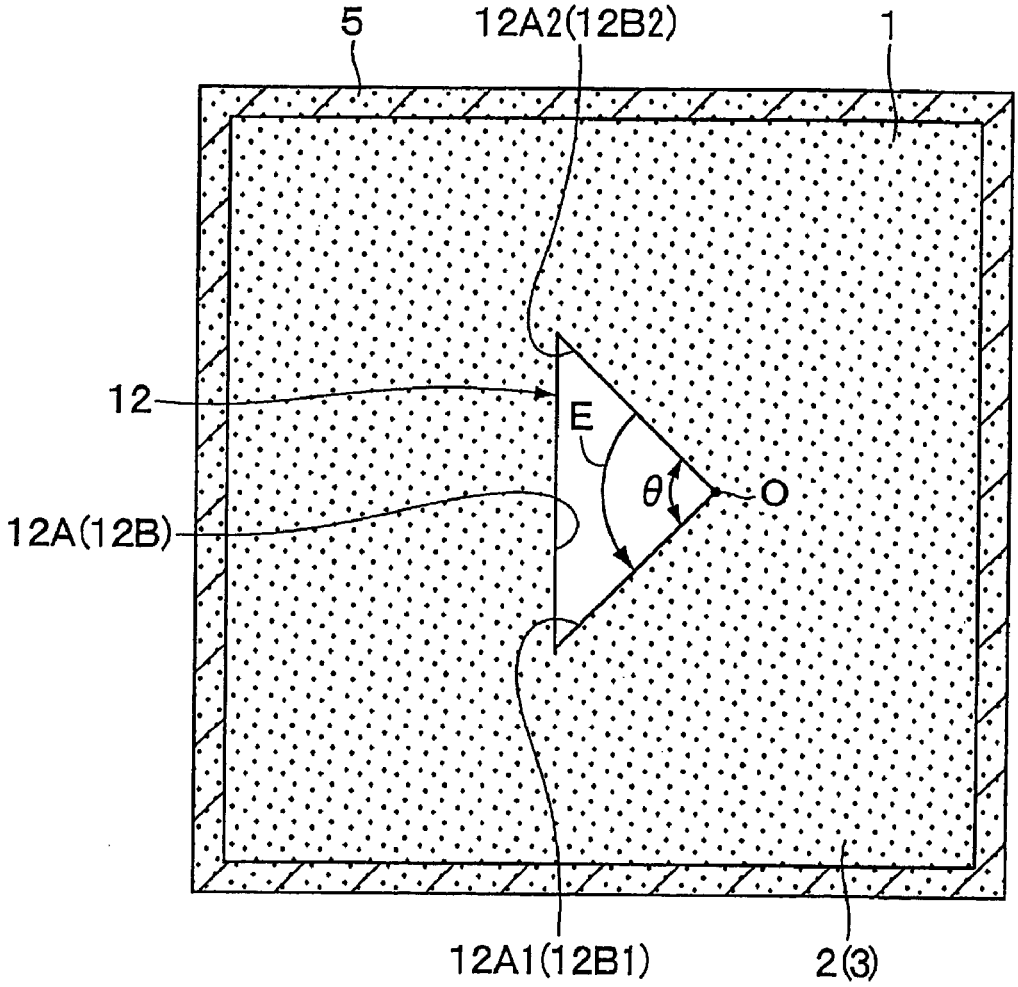
FIG. 11 is a cross-section view of a dielectric resonator device according to a second modification, viewed from the same direction as in FIG. 2.

Although the resonator 4 is composed of the fan-shaped apertures 4A and 4B, which are the fanned-out apertures, according to the first embodiment, the present invention is not limited to this structure. For example, arc apertures 11A and 11B set by cutting out a resonator composed of ring-shaped (doughnut-shaped) apertures along a radial line extending from the center may be used as in a resonator 11 shown in FIG. 10, according to a first modification. Alternatively, triangle apertures 12A and 12B may be used as in a resonator 12 shown in FIG. 11, according to a second modification.

According to the first modification, the arc aperture 11A formed in the front face 1A of the dielectric substrate 1 has two sides 11A1 and 11A2 on its fringe and the side 11A1 forms the central angle θ with the side 11A2 with respect to the central point O, and the arc aperture 11B formed in the rear face 1B of the dielectric substrate 1 has two sides 11B1 and 11B2 on its fringe and the side 11B1 forms the central angle θ with the side 11B2 with respect to the central point O. Similarly, according to the second modification, the triangle aperture 12A formed in the front face 1A of the dielectric substrate 1 has two sides 12A1 and 12A2 on its fringe and the side 12A1 forms the central angle θ with the side 12A2 with respect to the central point O, and the triangle aperture 12B formed in the rear face 1B of the dielectric substrate 1 has two sides 12B1 and 12B2 on its fringe and the side 12B1 forms the central angle θ with the side 12B2 with respect to the central point O.

Although the electrodes 2 and 3 are provided on the front face 1A and the rear face 1B, respectively, of the dielectric substrate 1 and the fan-shaped apertures 4A and 4B are provided in the electrodes 2 and 3, respectively, to form the resonator 4 according to the first embodiment, the present invention is not limited to this structure. The electrode 2 having the fanned-out aperture, for example, the fan-shaped aperture 4A, may be provided on the front face 1A of the dielectric substrate 1 and the electrode 3 may be omitted from the rear face 1B thereof to form the resonator. Alternatively, the electrode 2 having the fanned-out aperture, for example, the fan-shaped aperture 4A, may be provided on the front face 1A of the dielectric substrate 1 and the electrode 3 entirely grounded may be provided on the rear face 1B thereof to form the resonator.

Figure 12:
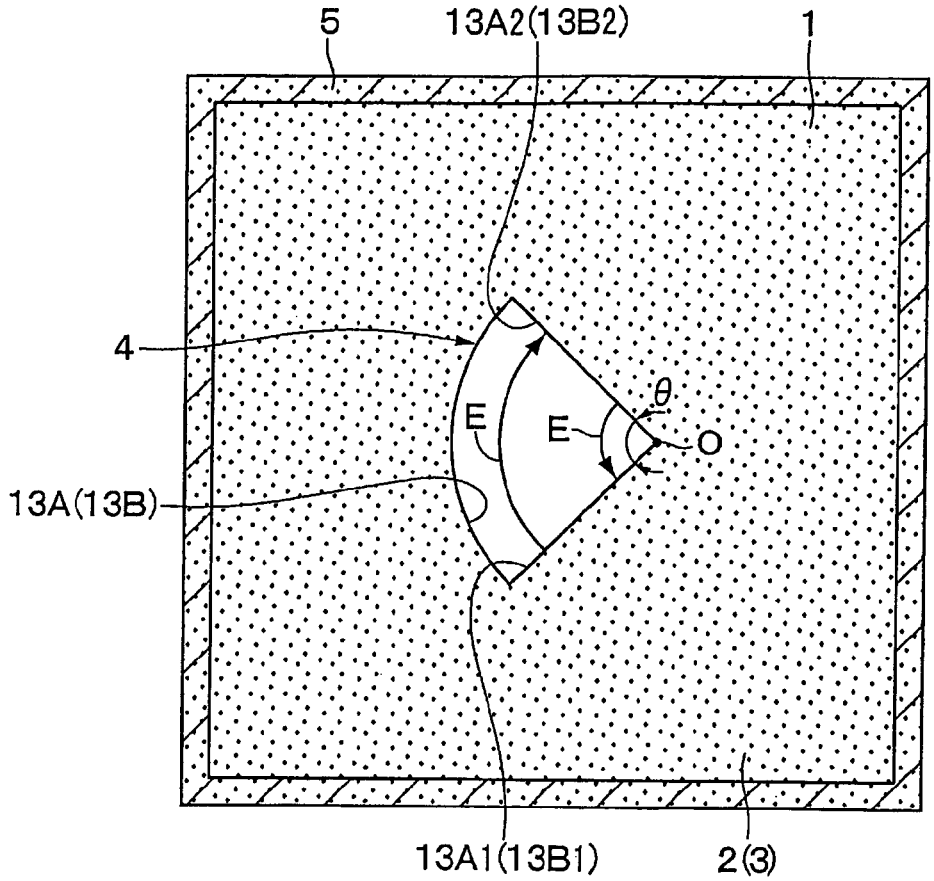
FIG. 12 is a cross-section view of a dielectric resonator device according to a third modification, viewed from the same direction as in FIG. 2.

Although one arc line E of electric force appears in the fan-shaped apertures 4A and 4B to form the resonator 4 functioning similarly to the half-wavelength resonator according to the first embodiment, the present invention is not limited to this structure. For example, two arc lines E of electric force may appear in fan-shaped apertures 13A and 13B to form a resonator 13 functioning similarly to one-wavelength resonator (multimode resonator), as in a third modification shown in FIG. 12. In this case, the arc aperture 13A formed in the front face 1A of the dielectric substrate 1 has two sides 13A1 and 13A2 on its fringe and the side 13A1 forms the central angle θ with the side 13A2 with respect to the central point O, and the arc aperture 13B formed in the rear face 1B of the dielectric substrate 1 has two sides 13B1 and 13B2 on its fringe and the side 13B1 forms the central angle θ with the side 13B2 with respect to the central point O.

Alternatively, a resonator having three or more (n number of) arc lines E of electric force in the fan-shaped apertures may be formed. In this case, the resonator functions similarly to an n/2-wavelength resonator.

Figure 13:
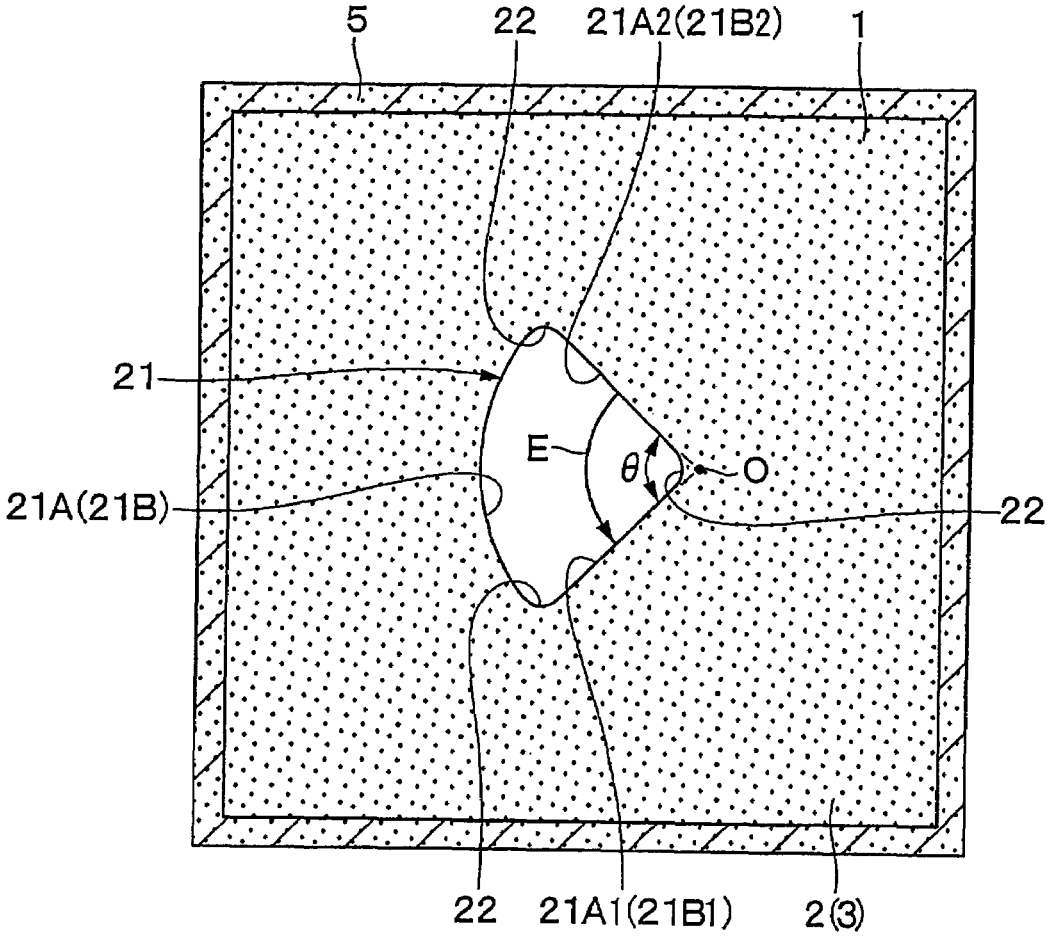
FIG. 13 is a cross-section view of a dielectric resonator device according to a second embodiment, viewed from the same direction as in FIG. 2.

FIG. 13 shows a dielectric resonator device according to a second embodiment of the present invention. The second embodiment is characterized in that fan-shaped apertures have chamfers at the corners on its fringe and the chamfers make the corners round. The same reference numerals are used in the second embodiment to identify the same components in the first embodiment. A detailed description of such components is omitted herein.

Reference numeral 21 denotes a fan-shaped resonator provided in the center of the dielectric substrate 1. The resonator 21 is composed of fan-shaped apertures 21A and 21B, which are fanned-out apertures formed in the electrodes 2 and 3, respectively, as in the resonator 4 according to the first embodiment. The fan-shaped aperture 21A opposes the fan-shaped aperture 21B with the dielectric substrate 1 sandwiched therebetween.

The fan-shaped aperture 21A has two sides 21A1 and 21A2 on its fringe. The side 21A1 forms the central angle θ with the side 21A2 with respect to the central point O. The fan-shaped aperture 21A is fanned out with respect to the central point O. Similarly, the fan-shaped aperture 21B has two sides 21B1 and 21B2 on its fringe. The side 21B1 forms the central angle θ with the side 21B2 with respect to the central point O. The fan-shaped aperture 21B has approximately the same shape as the fan-shaped aperture 21A. The resonator 4 has a resonant frequency f0, for example, of the order of several tens of gigahertz.

The fan-shaped aperture 21A has chamfers 22 at the three corners on its fringe and the fan-shaped aperture 21B also has chamfers 22 at the three corners on its fringe. The chamfers 22 make the corners round.

Approximately the same advantages as in the first embodiment can be achieved in the second embodiment. Furthermore, the chamfers 22 provided at the corners of the fan-shaped apertures 21A and 21B can alleviate concentration of current at the corners to suppress a reduction in the unloaded Q factor due to the concentration of the current.

Figure 14:
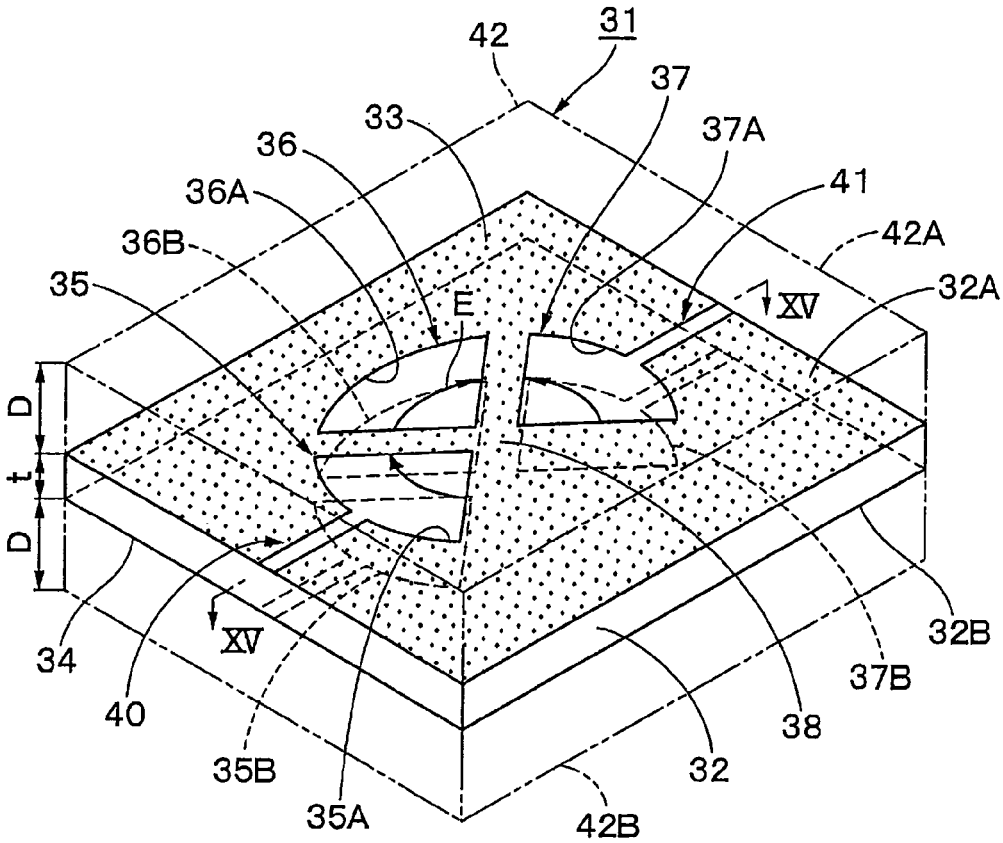
FIG. 14 is a perspective view of a dielectric filter according to a third embodiment.
Figure 15:
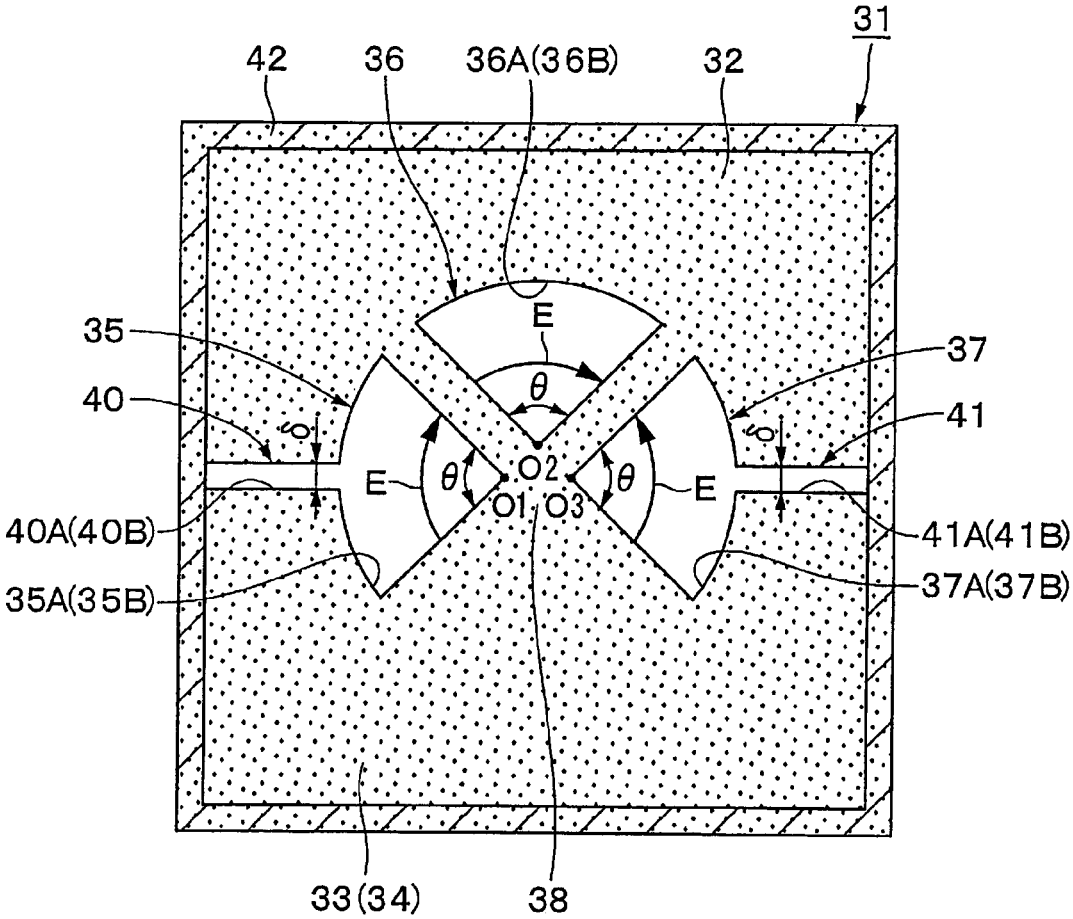
FIG. 15 is a cross-section view of the dielectric filter taken along line XV-XV in FIG. 14.
Figure 16:
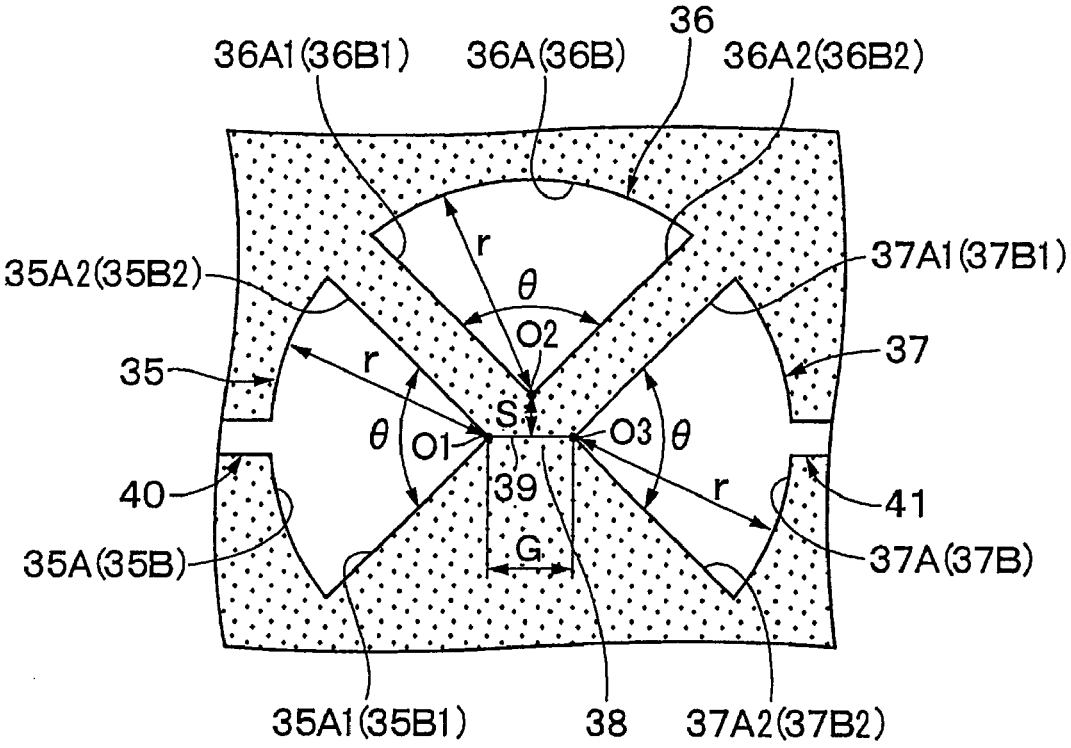
FIG. 16 is an enlarged view of the main part of the three resonators in FIG. 15.

FIGS. 14 to 16 show a dielectric filter according to a third embodiment of the present invention. The third embodiment is characterized in that three resonators composed of fan-shaped apertures are arranged in an arc such that the lines E of electric force of adjoining resonators appear opposite to each other in the dielectric filter.

Reference numeral 31 denotes a dielectric filter according to the third embodiment. The dielectric filter 31 includes three resonators 35 to 37 described below and others.

Reference numeral 32 denotes a substantially-rectangular and planar dielectric substrate. The dielectric substrate 32 is made of, for example, a resin material, a ceramic material, or a composite material in which the resin material is mixed with the ceramic material and the mixed material is sintered.

Reference numeral 33 denotes an electrode formed on a front face 32A of the dielectric substrate 32 and reference numeral 34 denotes an electrode formed on a rear face 32B thereof. The electrodes 33 and 34 are formed by high-precision patterning of conductive metallic thin films made of gold, copper, silver, or the like on both sides by using, for example, photolithography.

Reference numerals 35 to 37 denote fan-shaped resonators arranged in an arc, for example, in a substantially C-shaped arc, on the dielectric substrate 32. The resonators 35 to 37 are composed of fan-shaped apertures 35A to 37A and 35B to 37B formed in the electrodes 33 and 34, respectively, as in the resonator 4 according to the first embodiment. The three resonators 35 to 37 have approximately the same size and shape, as shown in FIG. 16. The fan-shaped apertures 35A to 37A and 35B to 37B each have the radius r and the central angle θ.

The fan-shaped aperture 35A has two sides 35A1 and 35A2 on its fringe. The side 35A1 forms the central angle θ with the side 35A2 with respect to a central point O1 (apex). The fan-shaped aperture 35A is fanned out with respect to the central point O1. Similarly, the fan-shaped aperture 35B has two sides 35B1 and 35B2 on its fringe. The side 35B1 forms the central angle θ with the side 35B2 with respect to the central point O1 (apex). The fan-shaped aperture 35B is fanned out with respect to the central point O1. The fan-shaped aperture 36A has two sides 36A1 and 36A2 on its fringe. The side 36A1 forms the central angle θ with the side 36A2 with respect to a central point O2 (apex). The fan-shaped aperture 36A is fanned out with respect to the central point O2. Similarly, the fan-shaped aperture 36B has two sides 36B1 and 36B2 on its fringe. The side 36B1 forms the central angle θ with the side 36B2 with respect to the central point O2 (apex). The fan-shaped aperture 36B is fanned out with respect to the central point O2. The fan-shaped aperture 37A has two sides 37A1 and 37A2 on its fringe. The side 37A1 forms the central angle θ with the side 37A2 with respect to a central point O3 (apex). The fan-shaped aperture 37A is fanned out with respect to the central point O3. Similarly, the fan-shaped aperture 37B has two sides 37B1 and 37B2 on its fringe. The side 37B1 forms the central angle θ with the side 37B2 with respect to the central point O3 (apex). The fan-shaped aperture 37B is fanned out with respect to the central point O3.

The central point O1 of the fan-shaped apertures 35A and 35B of the first-stage resonator 35, which is an input state, is apart from the central point O3 of the fan-shaped apertures 37A and 37B of the third-stage resonator 37, which is an output stage, by a distance G. The resonators 35 and 37 are symmetrically arranged in a butterfly shape with a central area 38 including the distance G sandwiched therebetween.

The second-stage resonator 36, which is an intermediate stage, is provided between the resonators 35 and 37 and is apart from the resonators 35 and 37 by an amount of shift S with reference to a line 39 connecting the central point O1 to the central point O3. Accordingly, the line E of electric force of the resonator 35 opposes the line E of electric force of the adjoining resonator 36, and the line E of electric force of the resonator 36 opposes the line E of electric force of the adjoining resonator 37.

The first-stage resonator 35 is magnetically coupled to the adjoining second-stage resonator 36, and the second-stage resonator 36 is also magnetically coupled to the adjoining third-stage resonator 37. In contrast, the first-stage resonator 35 is jump-coupled to the third-stage resonator 37, which is one or more stages away from the resonator 35.

Reference numeral 40 denotes a planar dielectric transmission line (hereinafter referred to as PDTL 40), which is connected to the resonator 35 and which is an input line. The PDTL 40 is provided in the electrodes 2 and 3, as shown in FIGS. 14 and 15, and is composed of slots 40A and 40B having a width δ, for example, of the order of 0.1 mm. The PDTL 40 is connected, for example, in the center of the outer fringe of the resonator 35 and straightly extends outward in the radial direction of the resonator 35.

Reference numeral 41 denotes a planar dielectric transmission line (hereinafter referred to as PDTL 41), which is connected to the resonator 37 and which is an output line. The PDTL 41 is provided in the electrodes 2 and 3, as shown in FIGS. 14 and 15, as in the PDTL 40, and is composed of slots 41A and 41B having the width 6, for example, of the order of 0.1 mm. The PDTL 41 is connected, for example, in the center of the outer fringe of the resonator 37 and straightly extends outward in the radial direction of the resonator 37.

Reference numeral 42 denotes a conductor casing covering the dielectric substrate 32. The conductor casing 42 is made of a conductive metallic material and is formed in a hollow box. The dielectric substrate 32 is housed in the conductor casing 42 and is fixed at a vertically intermediate position of the conductor casing 42, as shown in FIG. 14. The conductor casing 42 has a conductor face 42A apart from the front face 32A of the dielectric substrate 32 by a distance D and has a conductor face 42B apart from the rear face 32B of the dielectric substrate 32 by the distance D. The distance D is set to a value sufficient to attenuate a signal having a resonant frequency f0 and is set such that, for example, the cutoff frequency is higher than the resonant frequency f0.

The operation of the dielectric filter 31 having the above structure, according to the third embodiment, will be described below with reference to FIGS. 14 to 20.

First, when a high-frequency signal is transmitted to the PDTL 40, the high-frequency signal is supplied to the first-stage resonator 35. The first-stage resonator 35 excites the high-frequency signal corresponding to the resonant frequency of the resonator 35 and is magnetically coupled to the adjoining second-stage resonator 36 to excite the high-frequency signal corresponding to the resonant frequency of the resonator 36 in the resonator 36. Since the second-stage resonator 36 is also magnetically coupled to the adjoining third-stage resonator 37, only the signals corresponding to the resonant frequencies of the resonators 35 to 37, among the high-frequency signals transmitted to the PDTL 40, are propagated to the resonator 37, which is the output stage, and are output through the PDTL 41. Accordingly, the dielectric filter 31 serves as a bandpass filter.

Since the first-stage resonator 35 is jump-coupled to the third-stage resonator 37, an attenuation peak can appear at, for example, the low-frequency side of the passband.

In order to cause the attenuation peak to appear at a desired frequency in accordance with the attenuation specifications, the frequency of the attenuation peak is adjusted by varying the distance G between the resonators 35 and 37 or the central angle θ between the resonators 35 and 37. However, varying the distance G or the central angle θ simultaneously varies the coupling between the resonators 35 and 36 or the coupling between the resonators 36 and 37. Hence, the amount of shift S corresponding to the distances between the resonator 36 and the resonator 35 and between the resonator 36 and the resonator 37 is varied to keep the coupling between the resonators 35 and 36 and the coupling between the resonators 36 and 37 unchanged.

Figure 17:
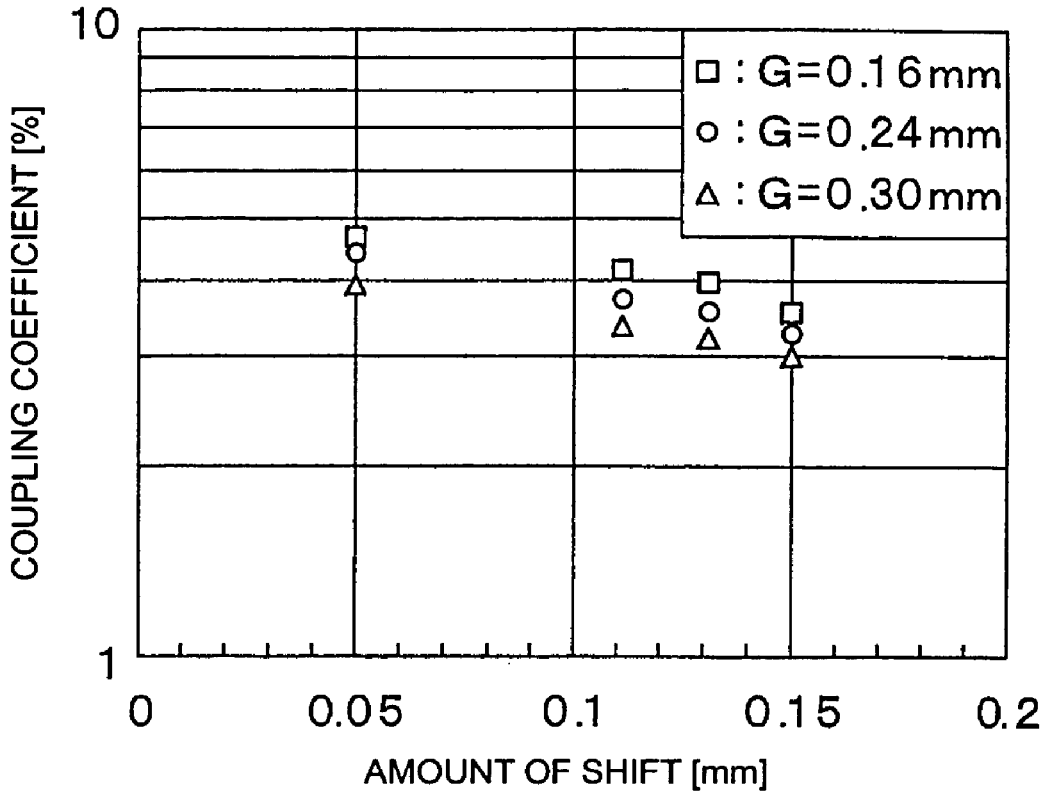
FIG. 17 is a graph illustrating the relationship between the amount of shift and the coupling coefficient of the resonators in FIG. 16.

The coupling coefficient k was calculated by using an electromagnetic-field simulator when the amount of shift S is varied by a parameter, the distance G. The calculation results are shown in FIG. 17 where, for example, the relative permittivity ∈r of the dielectric substrate 32 is set to 24, the thickness t of the dielectric substrate 32 is set to 0.3 mm, the radius r of the resonators 35 to 37 is set to 0.7 mm, the central angle θ of the resonators 35 to 37 is set to 90°, and the width δ of the PDTLs 40 and 41 is set to 0.1 mm. FIG. 17 shows that the coupling coefficient k is decreased as the distance G is increased and the coupling coefficient k is decreased as the amount of shift S is increased.

Figure 18:
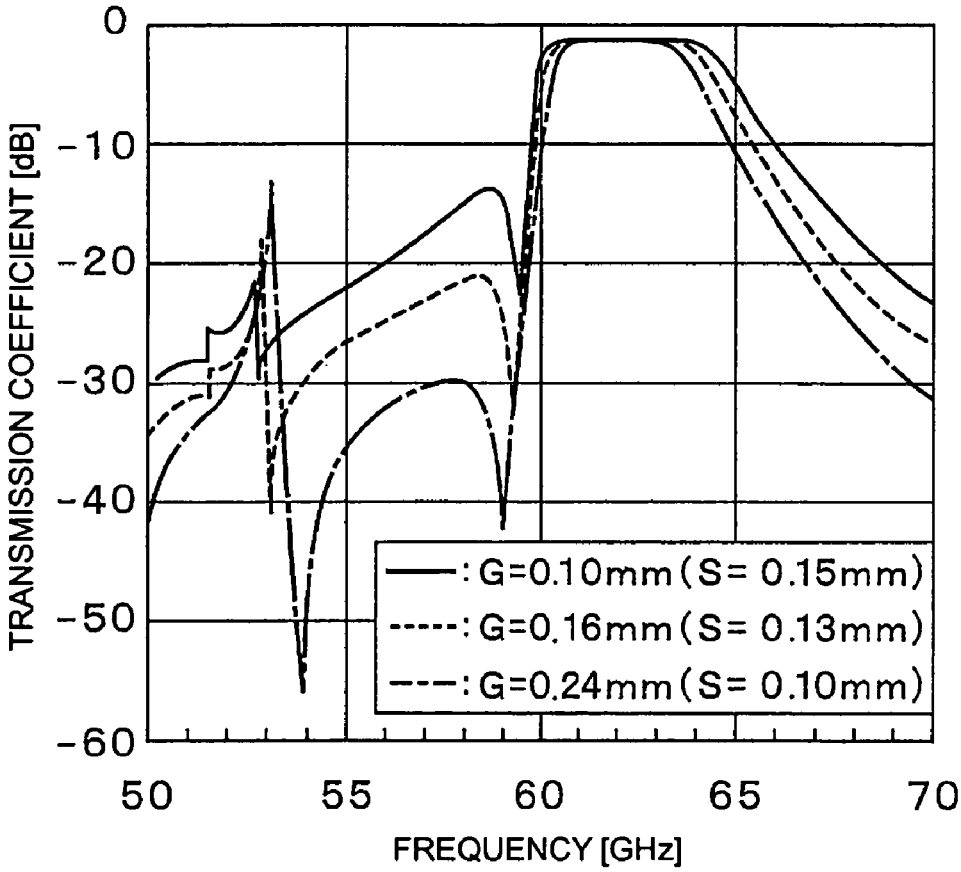
FIG. 18 is a diagram of characteristic lines, showing the relationship between the frequency and the transmission coefficient when the dielectric filter according to the third embodiment is used.

In addition, the frequency characteristics of the transmission coefficient S21 of the dielectric filter 31 were calculated by using the electromagnetic-field simulator under the same conditions as in the above calculation, where the distance G is set to 0.10 mm, 0.16 mm, and 0.24 mm. The calculation results are shown in FIG. 18. The amount of shift S is set to 0.15 mm, 0.13 mm, and 0.10 mm in accordance with the distance G so as to keep the coupling coefficient k constant. FIG. 18 shows that the attenuation peak appears around 59 GHz at the low-frequency side of the passband from 60 GHz to 64 GHz and the frequency of the attenuation peak gets close to the passband as the distance G is decreased in the dielectric filter 31. Although peaks of the transmission coefficient S21 appear around 53 GHz, these peaks are caused by a spurious mode in which the electric field appears in the radial direction of the resonators 35 to 37.

Figure 19:
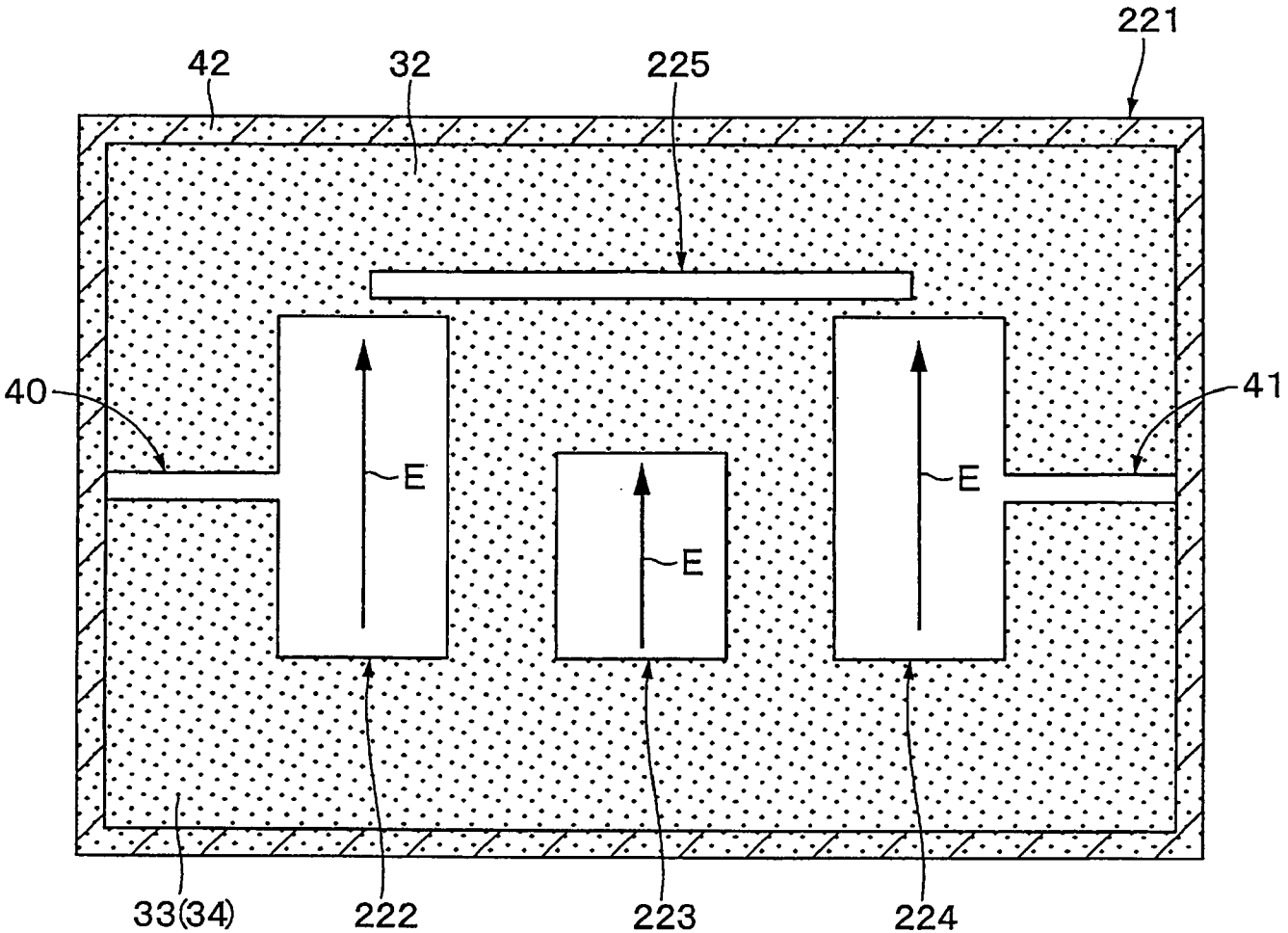
FIG. 19 is a cross-section view of a dielectric filter in a comparative example, viewed from the same direction as in FIG. 15.

FIG. 19 shows a comparative example in which three planar dielectric transmission line resonators 222 to 224 (hereinafter referred to as PDTL resonators 222 to 224) are arranged in a dielectric filter 221 such that the lines E of electric force of the PDTL resonators 222 to 224 are parallel to each other and a coupled line 225 for polarization, which is a straight planar-dielectric-transmission-line, is provided near the PDTL resonators 222 and 224. The frequency characteristics were calculated by using the electromagnetic-field simulator in this comparative example. The results of this analysis are shown in FIG. 20 where the frequency of the passband of the dielectric filter 221 and the frequency of the attenuation peak are set to approximately the same value as in the dielectric filter 31 according to third embodiment.

Figure 20:
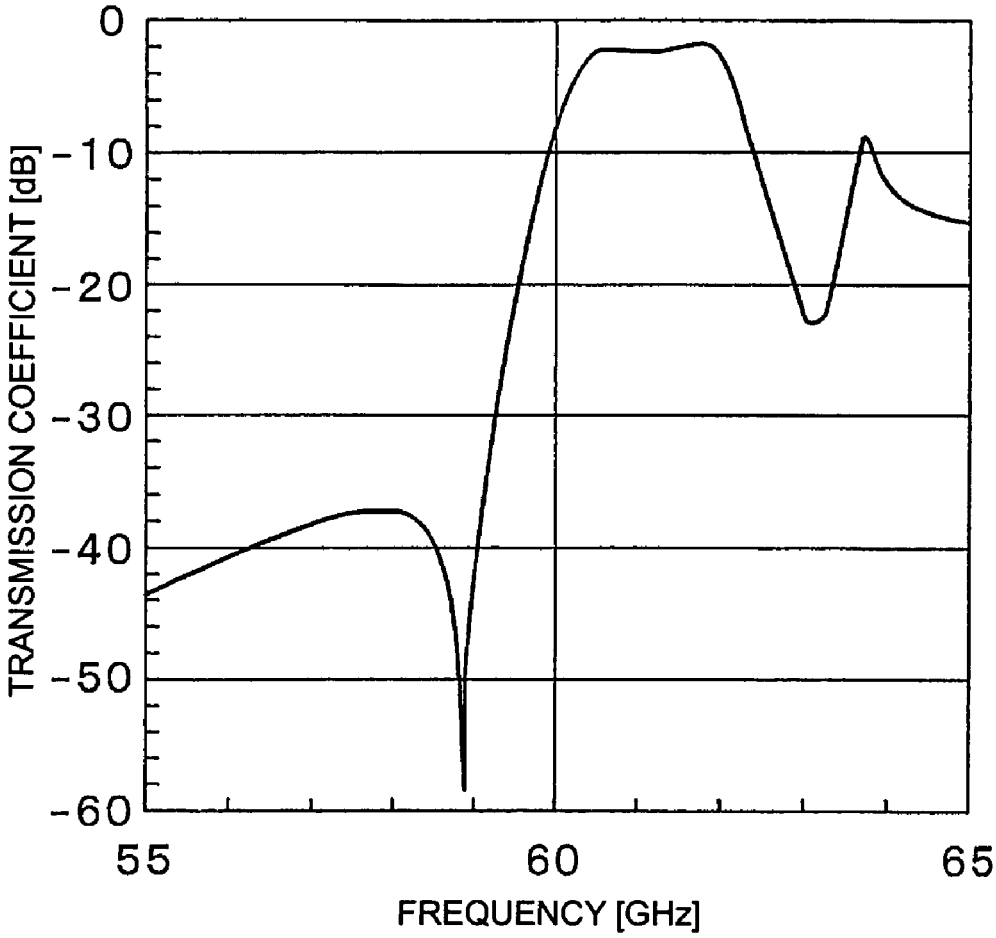
FIG. 20 is a diagram of characteristic lines, showing the relationship between the frequency and the transmission coefficient when the dielectric filter in the comparative example is used.

FIG. 20 shows that the passband appears in a frequency range from 60 GHz to 62 GHz and an attenuation peak appears around 59 GHz. However, a peak of the transmission coefficient S21 also appears around 63.6 GHz at the high-frequency side of the passband in the dielectric filter 221 according to the comparative example. This peak, which is caused by a resonance (a spurious response) corresponding to one wavelength of the coupled line 225 for polarization, deteriorates the attenuation characteristics at the high-frequency side.

In contrast, since unlike the comparative example, the dielectric filter 31 according to the third embodiment does not have the coupled line 225 for polarization, it possible to eliminate the spurious response due to the coupled line for polarization, thus improving the attenuation characteristics at the high-frequency or low-frequency side of the passband.

As in the first embodiment, the resonant frequency can be set by using the two parameters, that is, the radius r and the central angle θ, of the resonators 35 to 37 in the third embodiment, so that the flexibility in design of the resonators 35 to 37 and the dielectric filter 31 can be improved.

Since the fan-shaped apertures 35A to 37A and the opposing fan-shaped apertures 35B to 37B are provided in the electrodes 33 and 34 on both the front face 32A and the rear face 32B, respectively, of the dielectric substrate 32, it is possible to improve the flexibility in design of the resonators 35 to 37, compared with the case in which only the fan-shaped apertures 35A to 37A are provided. Furthermore, concentration of current at the fringes of the resonators 35 to 37 can be alleviated to increase the unloaded Q factor.

Particularly, since the lines E of electric force of the adjoining resonators 35 to 37 appear opposite to each other in the third embodiment, the adjoining resonators 35 to 37 can be magnetically coupled to each other.

Current tends to spread out in the extending direction of the lines E of electric force around the fan-shaped apertures 35A to 37A and the fan-shaped apertures 35B to 37B of the resonators 35 to 37 in the electrodes 33 and 34. Accordingly, when the PDTL resonators 222 to 224 are arranged such that the lines E of electric force thereof are parallel to each other, as in the comparative example shown in FIG. 19, there is a problem in that current spreads out from both the top edges and the bottom edges of the PDTL resonators 222 to 224 (upward and downward in FIG. 19) to adversely affect other devices provided around the dielectric filter 221.

In contrast, since the fan-shaped apertures 35A to 37A and the fan-shaped apertures 35B to 37B of the adjoining resonators 35 to 37 are arranged such that the lines E of electric force thereof appear opposite to each other in the third embodiment, the fan-shaped apertures 35A to 37A and the fan-shaped apertures 35B to 37B of the adjoining resonators 35 to 37 are provided in the direction in which the current spreads out, thus suppressing the spread of the current. As a result, other devices can be provided around the dielectric filter 31 to increase the packing density of the entire dielectric resonator device.

The structure in which the fan-shaped apertures 35A to 37A and the fan-shaped apertures 35B to 37B are arranged in an arc allows the resonators 35 to 37 to be provided such that the lines E of electric force thereof appear opposite to each other to magnetically couple the adjoining resonators 35 to 37 to each other. Furthermore, since the resonators 35 and 37, the resonator 35 being one or more stages away from the resonator 37, are symmetrically arranged with the central area 38 sandwiched therebetween, the resonator 35 can be jump-coupled to the resonator 37 to cause the attenuation peak to appear at the high-frequency or low-frequency side of the passband.

When the three PDTL resonators 222 to 224 are used as in the comparative example, the length of each of the PDTL resonators 222 to 224 is set to, for example, about half of one wavelength of the resonant frequency. Accordingly, the three PDTL resonators 222 to 224 are arranged in a rectangle having a length that is equal to one and half or more of one wavelength of the resonant frequency. Since the coupled line 225 for polarization is provided near the PDTL resonators 222 to 224 in the comparative example, it is necessary to reserve an area for the coupled line 225 for polarization.

In contrast, according to the third embodiment, the fan-shaped apertures 35A to 37A and the fan-shaped apertures 35B to 37B are arranged in an arc, so that the three resonators 35 to 37 can be housed in an approximately circular area. Since the radius r of each of the resonators 35 to 37 is set to a value, for example, about half of one wavelength of the resonant frequency, the three resonators 35 to 37 can be housed in a circle having a diameter that is nearly equal to the one wavelength of the resonant frequency. In addition, the resonator 35 can be jump-coupled to the resonator 37 without the coupled line 225 for polarization in the third embodiment.

As a result, the dielectric filter 31 according to the third embodiment can be housed in an area that corresponds to, for example, about seventy percent of the area where the dielectric filter 221 in the comparative example can be housed, thus reducing in size of the dielectric filter 31.

Since the dielectric substrate 32 is fixed in the conductor casing 42 such that the front face 32A and the rear face 32B of the dielectric substrate 32 opposes the conductor faces 42A and 42B, respectively, adjustment of the distance D can prevent the electromagnetic waves from being propagated in spaces between the conductor face 42A and the electrode 33 and between the conductor face 42B and the electrode 34. Hence, energy can be locked in the resonators 35 to 37 to reduce the radiation loss in the resonators 35 to 37 and to suppress the reduction in the unloaded Q factor.

Although the three resonators 35 to 37 have the same radius r and the central angle θ in the third embodiment, the present invention is not limited to this structure. The three resonators may have different radii and central angles.

Figure 21:
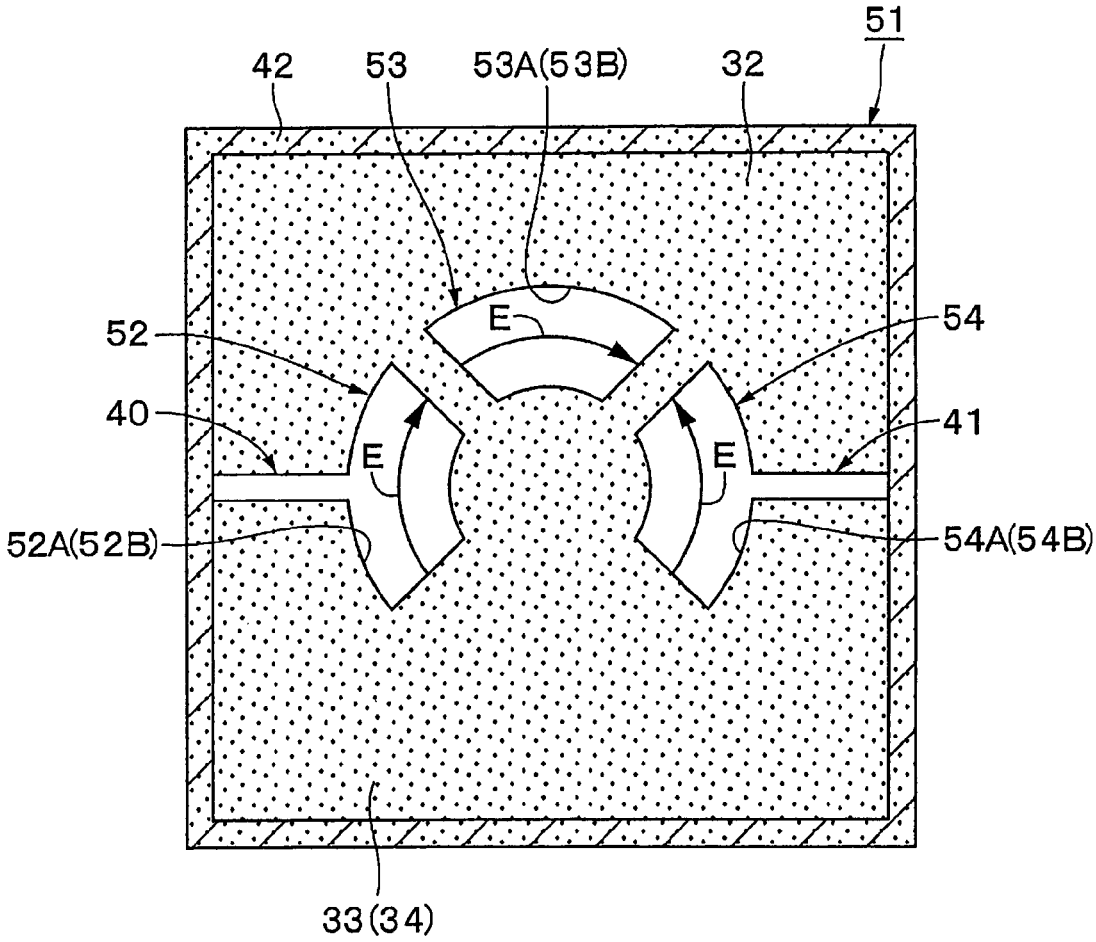
FIG. 21 is a cross-section view of a dielectric filter according to a fourth modification, viewed from the same direction as in FIG. 15.
Figure 22:
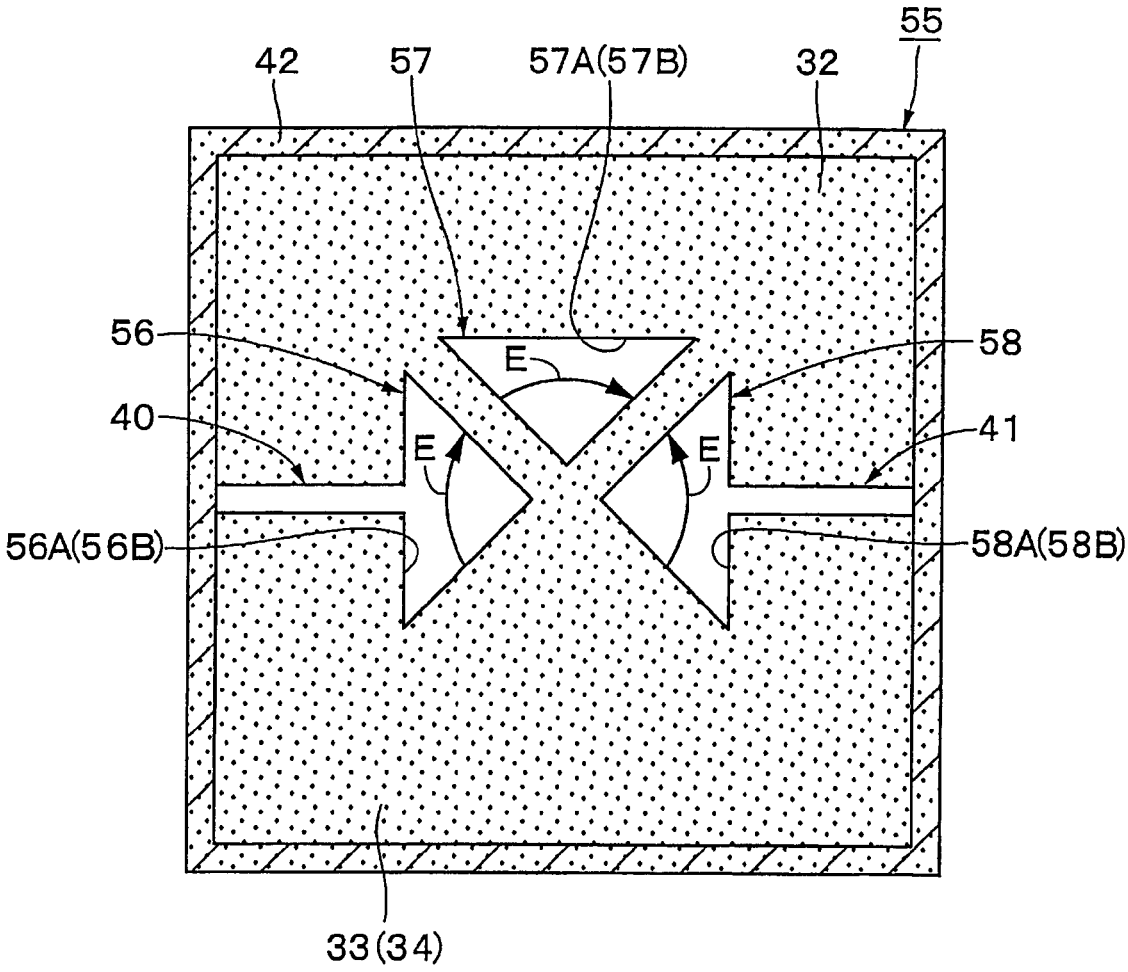
FIG. 22 is a cross-section view of a dielectric filter according to a fifth modification, viewed from the same direction as in FIG. 15.

Although the dielectric filter 31 has the resonators 35 to 37 composed of the fan-shaped apertures 35A to 37A and the fan-shaped apertures 35B to 37B, which are fanned-out apertures, in the third embodiment, the present invention is not limited to this structure. For example, as in a dielectric filter 51 in FIG. 21, according to a fourth modification, resonators 52 to 54 composed of arc apertures 52A to 54A and arc apertures 52B to 54B may be used. Alternatively, as in a dielectric filter 55 in FIG. 22, according to a fifth modification, resonators 56 to 58 composed of triangle apertures 56A to 58A and triangle apertures 56B to 58B may be used.

Figure 23:
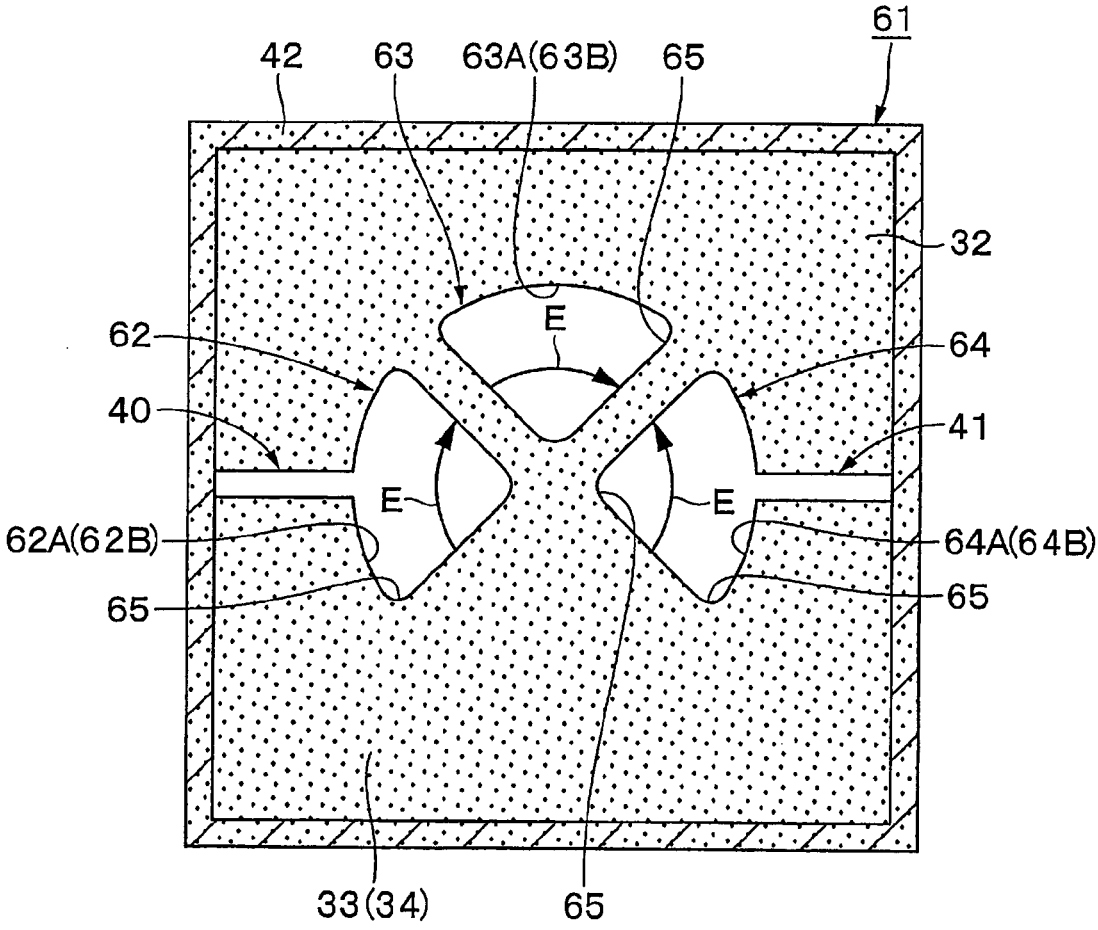
FIG. 23 is a cross-section view of a dielectric filter according to a fourth embodiment, viewed from the same direction as in FIG. 15.

FIG. 23 shows a dielectric filter according to a fourth embodiment of the present invention. The fourth embodiment is characterized in that the fan-shaped apertures of resonators have chamfers at the corners on their fringe and the chamfers make corners round. The same reference numerals are used in the fourth embodiment to identify the same components in the third embodiment. A detailed description of such components is omitted herein.

Reference numeral 61 denotes a dielectric filter according to the fourth embodiment. The dielectric filter 61 includes three resonators 62 to 64 described below.

Reference numerals 62 to 64 denote fan-shaped resonators arranged in an arc, for example, in a substantially C-shaped arc, on the dielectric substrate 32. The fan-shaped resonators 62 to 64 are composed of fan-shaped resonators 62A to 64A and 62B to 64B formed in the electrodes 33 and 34, as in the resonator 4 according to the first embodiment. The line E of electric force of the resonator 62 opposes the line E of electric force of the adjoining resonator 63, and the line E of electric force of the resonator 63 opposes the line E of electric force of the adjoining resonator 64. The PDTL 40 is connected to the first-stage resonator 62 and the PDTL 41 is connected to the third-stage resonator 64.

Reference numeral 65 denotes chamfers provided at the corners of the fan-shaped resonators 62A to 64A and 62B to 64B. The chamfers 65 make the corners of the fan-shaped resonators 62A to 64A and 62B to 64B round.

Approximately the same advantages as in the third embodiment can be achieved in the fourth embodiment. Since the chamfers 65 provided at the corners of the fan-shaped resonators 62A to 64A and 62B to 64B can alleviate concentration of current at the corners to suppress a reduction in the unloaded Q factor in the fan-shaped resonators 62 to 64 in the fourth embodiment. Accordingly, the radiation loss in the dielectric filter 61 can be reduced.

Figure 24:
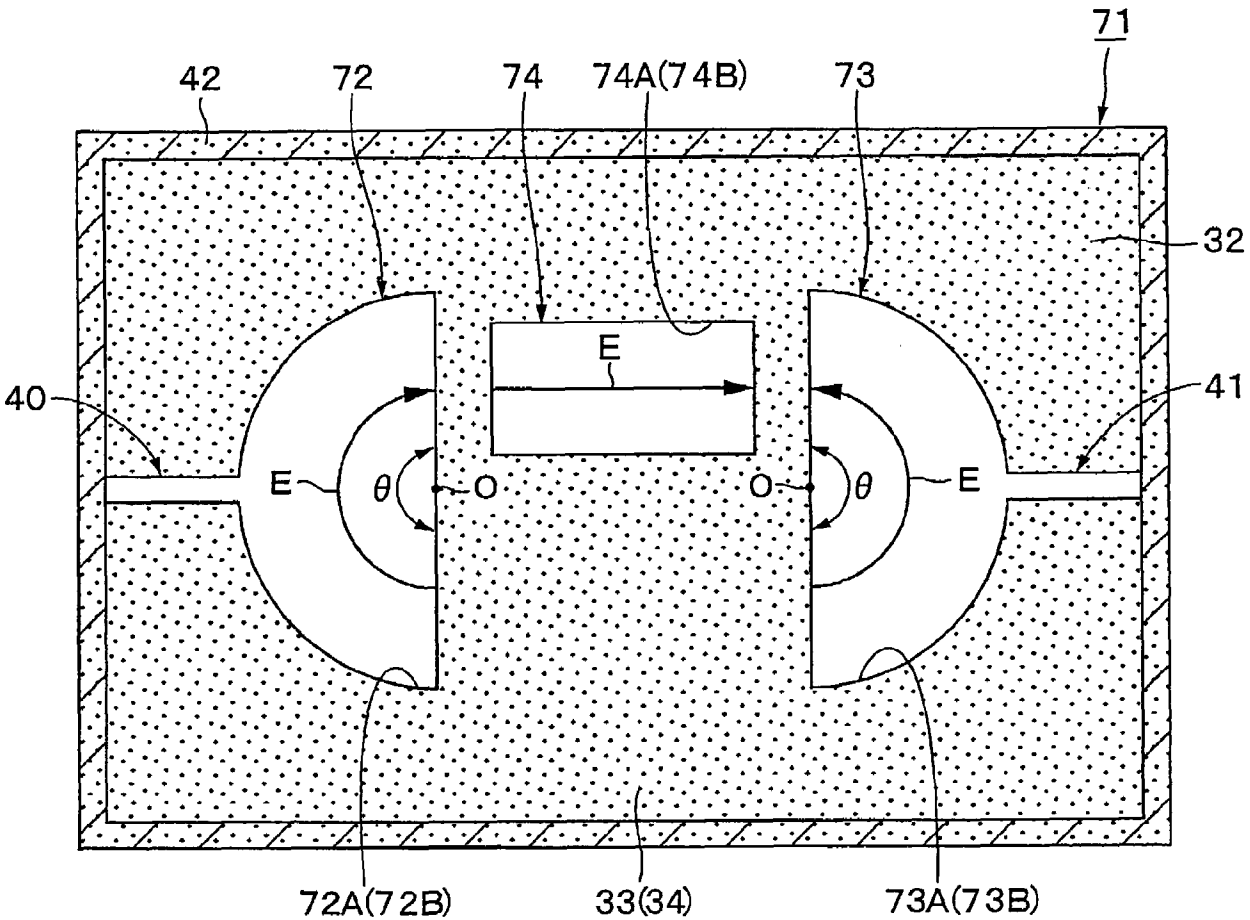
FIG. 24 is a cross-section view of a dielectric filter according to a fifth embodiment, viewed from the same direction as in FIG. 15.

FIG. 24 shows a dielectric filter according to a fifth embodiment of the present invention. The fifth embodiment is characterized in that an input-stage resonator and an output-stage resonator are composed of semicircular apertures and a PDTL resonator composed of rectangular apertures is provided between the semicircular apertures. The same reference numerals are used in the fifth embodiment to identify the same components in the third embodiment. A detailed description of such components is omitted herein.

Reference numeral 71 denotes a dielectric filter according to the fifth embodiment. The dielectric filter 71 includes three resonators 72 to 74 described below.

Reference numeral 72 denotes an input-stage resonator provided in the dielectric substrate 32. The resonator 72 is composed of semicircular apertures 72A and 72B formed in the electrodes 33 and 34, respectively. The semicircular aperture 72A opposes the semicircular aperture 72B with the dielectric substrate 32 sandwiched therebetween. The semicircular apertures 72A and 72B are fanned-out apertures (fan-shaped apertures) having the central angle θ with respect to the central point O. The PDTL 40 is connected to the resonator 72.

Reference numeral 73 denotes an output-stage resonator provided in the dielectric substrate 32. As in the resonator 72, the resonator 73 is composed of semicircular apertures 73A and 73B, which are fanned-out apertures, formed in the electrodes 33 and 34, respectively. The semicircular aperture 73A opposes the semicircular aperture 73B with the dielectric substrate 32 sandwiched therebetween. The PDTL 41 is connected to the resonator 73.

The resonators 72 and 73 are symmetrically arranged with a resonator 74 described below sandwiched therebetween. The semicircular apertures 72A and 72B and the semicircular apertures 73A and 7B are fanned out with respect to the resonator 74. An arc line E of electric force appears in each of the resonators 72 and 73. The resonator 72 is jump-coupled to the resonator 73.

Reference numeral 74 denotes an intermediate-stage planar dielectric transmission line resonator (hereinafter referred to as the PDTL resonator 74) provided between the resonators 72 and 73. The PDTL resonator 74 is composed of rectangular apertures 74A and 74B formed in the electrodes 33 and 34, respectively. The PDTL resonator 74 is provided such that the line E of electric force of the PDTL resonator 74 opposes the line E of electric force of the resonator 72 and that of the resonator 73. Accordingly, the PDTL resonator 74 is magnetically coupled to the resonators 72 and 73.

Approximately the same advantages as in the third embodiment can be achieved in the fifth embodiment.

Figure 25:
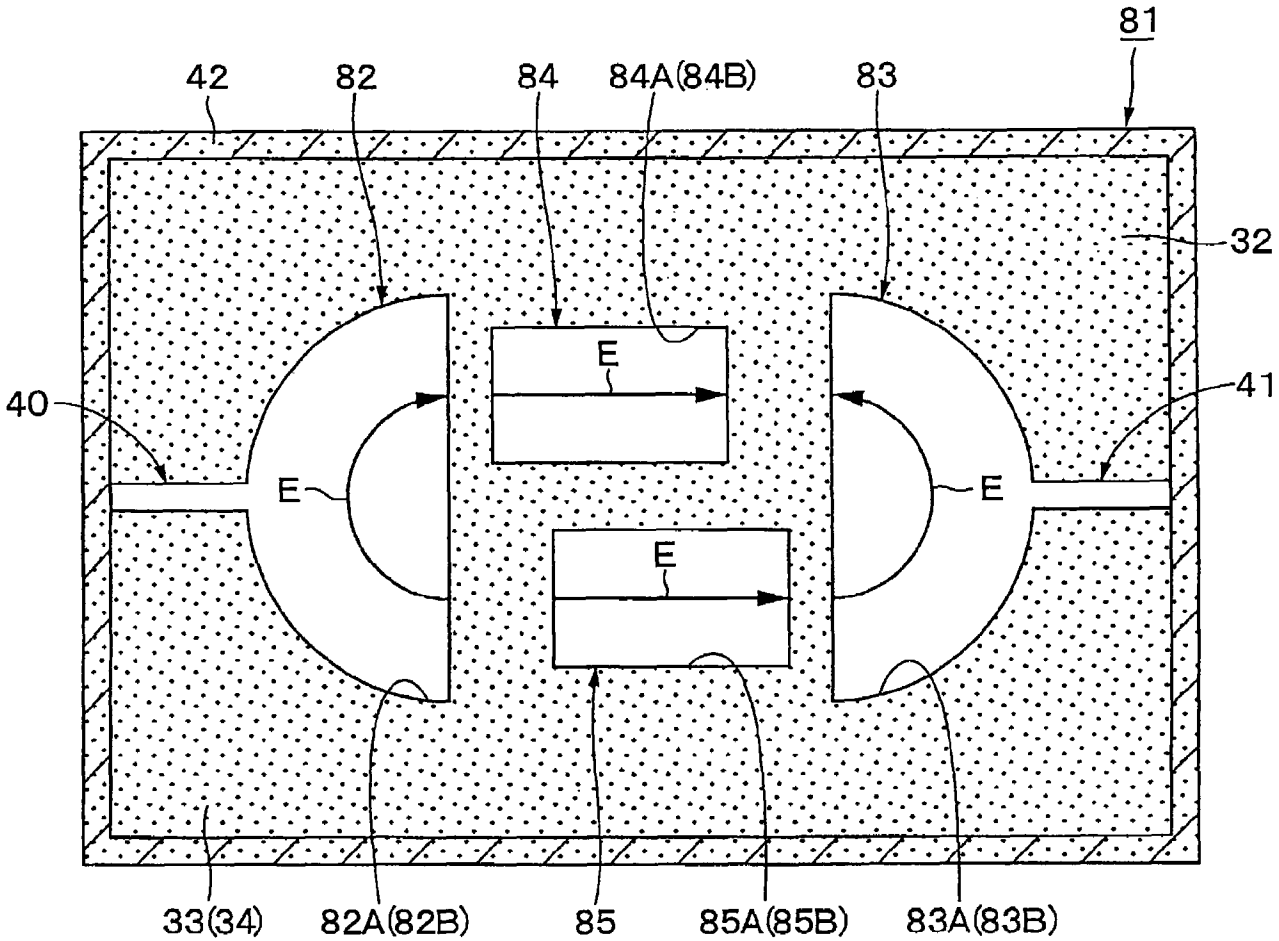
FIG. 25 is a cross-section view of a dielectric filter according to a sixth embodiment, viewed from the same direction as in FIG. 15.

FIG. 25 shows a dielectric filter according to a sixth embodiment of the present invention. The sixth embodiment is characterized in that an input-stage resonator and an output-stage resonator are composed of semicircular apertures and two PDTL resonators composed of rectangular apertures is provided between the semicircular apertures. The same reference numerals are used in the sixth embodiment to identify the same components in the third embodiment. A detailed description of such components is omitted herein.

Reference numeral 81 denotes a dielectric filter according to the sixth embodiment. The dielectric filter 81 includes four resonators 82 to 85 described below.

Reference numeral 82 denotes an input-stage resonator provided in the dielectric substrate 32. The resonator 82 is composed of semicircular apertures 82A and 82B formed in the electrodes 33 and 34, respectively. The semicircular aperture 82A opposes the semicircular aperture 82B with the dielectric substrate 32 sandwiched therebetween. The PDTL 40 is connected to the resonator 82.

Reference numeral 83 denotes an output-stage resonator provided in the dielectric substrate 32. As in the resonator 82, the resonator 83 is composed of semicircular apertures 83A and 83B, which are fanned-out apertures, formed in the electrodes 33 and 34, respectively. The semicircular aperture 83A opposes the semicircular aperture 83B with the dielectric substrate 32 sandwiched therebetween. The PDTL 41 is connected to the resonator 83.

The resonators 82 and 83 are symmetrically arranged with resonators 84 and 85 described below sandwiched therebetween. The semicircular apertures 82A and 82B and the semicircular apertures 83A and 8B are fanned out with respect to the resonators 84 and 85. An arc line E of electric force appears in each of the resonators 82 and 83.

Reference numeral 84 denotes a planar dielectric transmission line resonator (hereinafter referred to as the PDTL resonator 84), which is a first intermediate stage resonator. The PDTL resonator 84 is provided between the resonators 82 and 83 and is composed of rectangular apertures 84A and 84B formed in the electrodes 33 and 34, respectively. The PDTL resonator 84 is provided such that the line E of electric force thereof opposes the line E of electric force of the adjoining input-stage resonator 82. The line E of electric force of the PDTL resonator 84 also opposes the line E of electric force of the output-stage resonator 83, which is one stage away from the resonator 84. Accordingly, the PDTL resonator 84 is magnetically coupled to the input-stage resonator 82 and is also magnetically coupled to the output-stage resonator 83.

Reference numeral 85 denotes a planar dielectric transmission line resonator (hereinafter referred to as the PDTL resonator 85), which is a second intermediate stage resonator. The PDTL resonator 85 is provided between the resonators 82 and 83 and is composed of rectangular apertures 85A and 85B formed in the electrodes 33 and 34, respectively, as in the PDTL resonator 84. The PDTL resonator 85 is provided such that the line E of electric force thereof is parallel to the line E of electric force of the adjoining PDTL resonator 84 and opposes the line E of electric force of the adjoining output-stage resonator 82. The line E of electric force of the PDTL resonator 85 also opposes the line E of electric force of the input-stage resonator 82, which is one stage away from the resonator 85. Accordingly, the PDTL resonator 85 is magnetically coupled to the adjoining PDTL resonator 84, is magnetically coupled to the adjoining output-stage resonator 83, and is also magnetically coupled to the input-stage resonator 82.

Since the input-stage resonator 82 is magnetically coupled to the first intermediate-stage PDTL resonator 84, the first intermediate-stage PDTL resonator 84 is magnetically coupled to the second intermediate-stage PDTL resonator 85, and the second intermediate-stage PDTL resonator 85 is magnetically coupled to the output-stage resonator 83, only high-frequency signals within a predetermined bandwidth can be transmitted through these resonators 82 to 85. Hence, the dielectric filter 81 serves as a bandpass filter.

Since the input-stage resonator 82 is jump-coupled to the second intermediate-stage PDTL resonator 85 by the magnetic coupling and the output-stage resonator 83 is jump-coupled to the first intermediate-stage PDTL resonator 84 by the magnetic coupling, the attenuation peak appears at the high-frequency or low-frequency side of the passband.

Approximately the same advantages as in the third embodiment can be achieved in the sixth embodiment.

Figure 26:
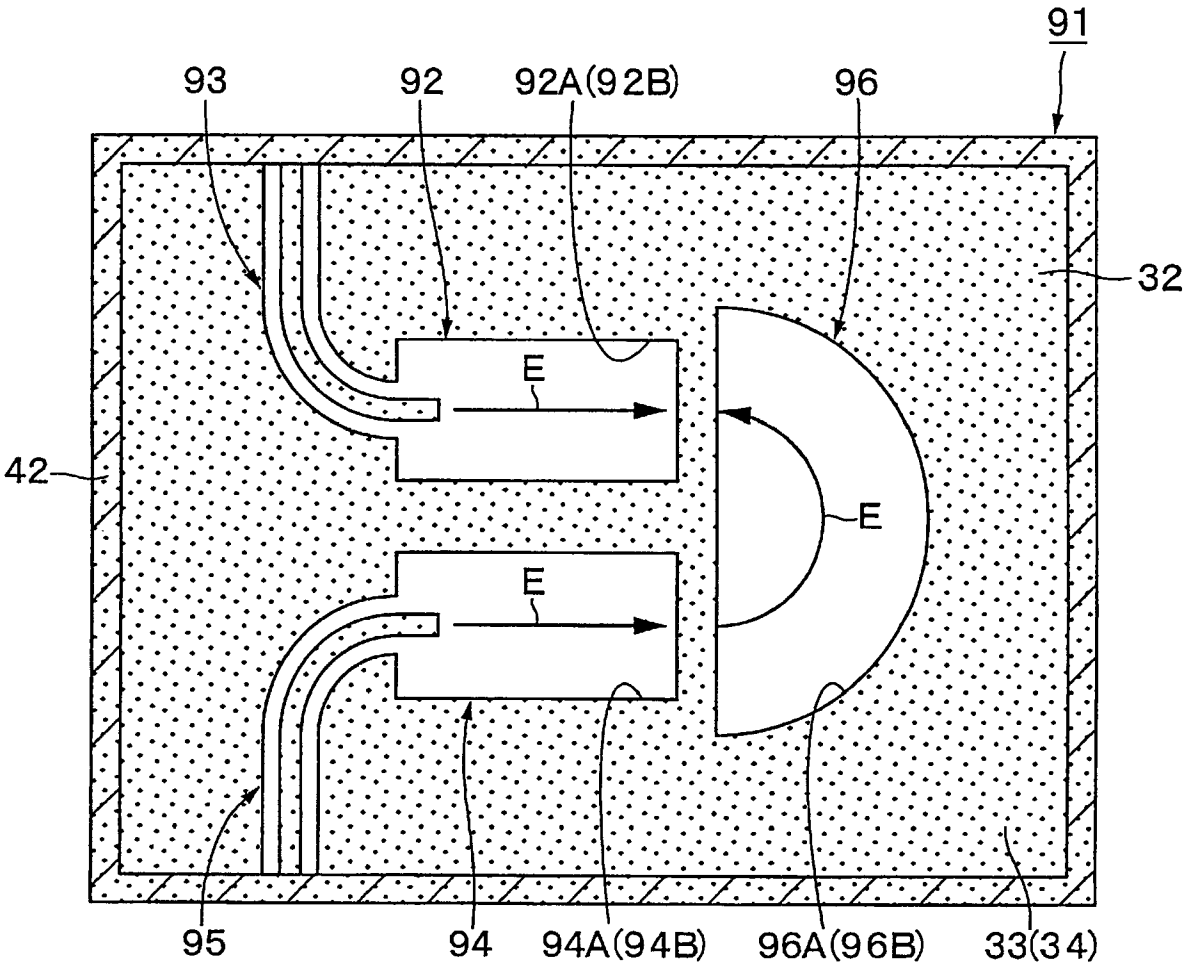
FIG. 26 is a cross-section view of a dielectric filter according to a seventh embodiment, viewed from the same direction as in FIG. 15.

FIG. 26 shows a dielectric filter according to a seventh embodiment of the present invention. The seventh embodiment is characterized in that an input-stage resonator and an output-stage resonator are each composed of rectangular apertures and the input-stage resonator is coupled to the output-stage resonator via a resonator composed of semicircular apertures. The same reference numerals are used in the seventh embodiment to identify the same components in the third embodiment. A detailed description of such components is omitted herein.

Reference numeral 91 denotes a dielectric filter according to the seventh embodiment. The dielectric filter 91 includes three resonators 92, 94, 96 described below.

Reference numeral 92 denotes a planar dielectric transmission line resonator (hereinafter referred to as the PDTL resonator 92), which is an input-stage resonator. The PDTL resonator 92 is composed of rectangular apertures 92A and 92B formed in the electrodes 33 and 34, respectively. The rectangular aperture 92A opposes the rectangular aperture 92B with the dielectric substrate 32 sandwiched therebetween. One end of the PDTL resonator 92 is connected to a coplanar line 93, which is an input line, and the other end of the PDTL resonator 92 is adjacent to a resonator 96 describe below.

Reference numeral 94 denotes a planar dielectric transmission line resonator (hereinafter referred to as the PDTL resonator 94), which is an output-stage resonator. As in the PDTL resonator 92, the PDTL resonator 94 is composed of rectangular apertures 94A and 94B formed in the electrodes 33 and 34, respectively. The rectangular aperture 94A opposes the rectangular aperture 94B with the dielectric substrate 32 sandwiched therebetween. One end of the PDTL resonator 94 is connected to a coplanar line 95, which is an output line, and the other end of the PDTL resonator 94 is adjacent to a resonator 96 describe below.

The PDTL resonators 92 and 94 are arranged such that the line E of electric force of the PDTL resonator 92 is parallel to that of the PDTL resonator 94. Accordingly, the PDTL resonator 92 is magnetically coupled to the PDTL resonator 94, so that the PDTL resonator 92 can be jump-coupled to the PDTL resonator 94 and, therefore, the attenuation peak appears at one side of the passband.

Reference numeral 96 denotes an intermediate-stage resonator provided at the other ends of the PDTL resonators 92 and 94. The resonator 96 is composed of semicircular apertures 96A and 96B formed in the electrodes 33 and 34, respectively. The semicircular aperture 96A opposes the rectangular aperture 96B with the dielectric substrate 32 sandwiched therebetween. An arc line E of electric force appears in the resonator 96. The resonator 96 is arranged such that the line E of electric force thereof opposes the lines E of electric force of the adjoining PDTL resonators 92 and 94. Accordingly, the resonator 96 is magnetically coupled to the PDTL resonators 92 and 94.

Approximately the same advantages as in the third embodiment can be achieved in the seventh embodiment.

Figure 27:
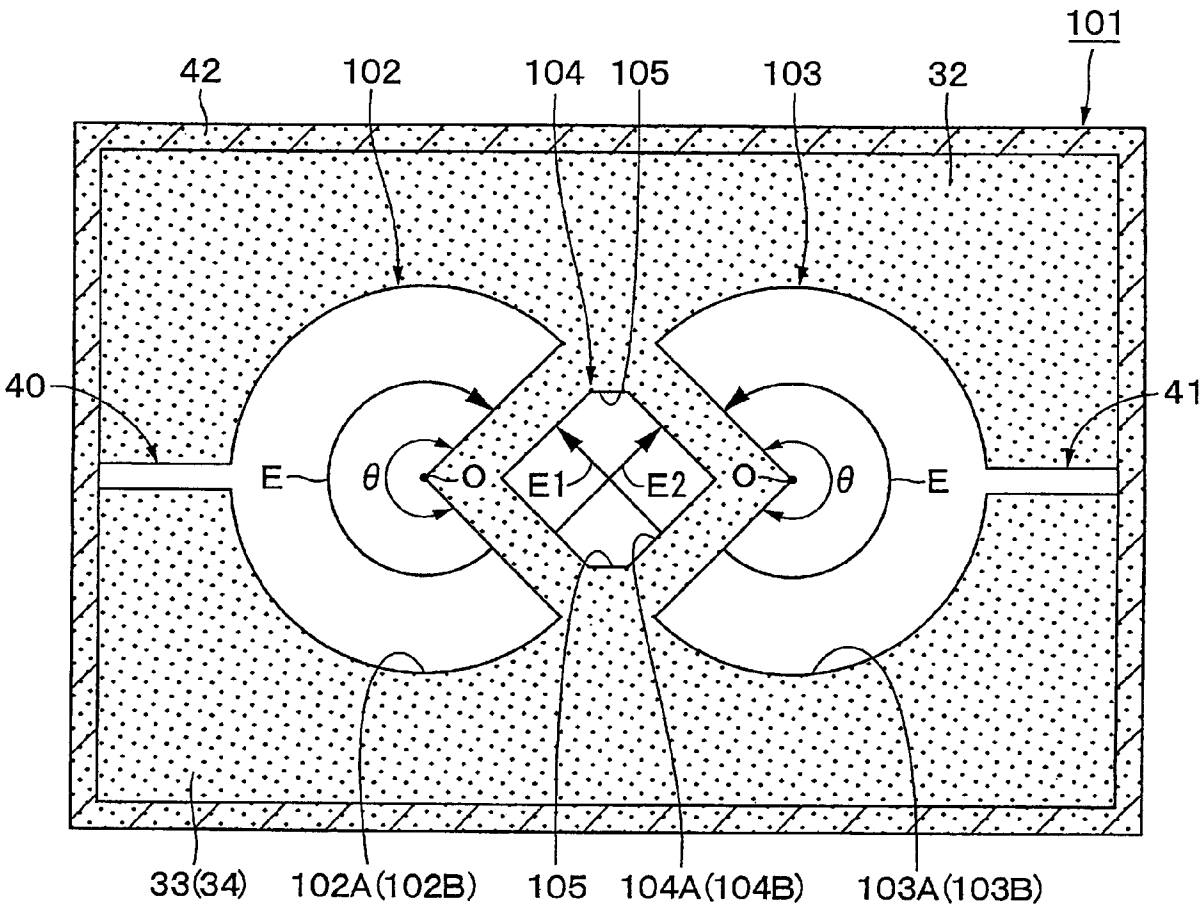
FIG. 27 is a cross-section view of a dielectric filter according to an eighth embodiment, viewed from the same direction as in FIG. 15.

FIG. 27 shows a dielectric filter according to an eighth embodiment of the present invention. The eighth embodiment is characterized in that input-stage and output-stage resonators are each composed of fan-shaped apertures having a central angle θ of 180° or more and a dual-mode resonator, which resonates in two modes, is provided between the two fan-shaped apertures. The same reference numerals are used in the eighth embodiment to identify the same components in the third embodiment. A detailed description of such components is omitted herein.

Reference numeral 101 denotes a dielectric filter according to the eighth embodiment. The dielectric filter 101 includes three resonators 102 to 104 described below.

Reference numeral 102 denotes an input-stage resonator provided in the dielectric substrate 32. The resonator 102 is composed of fan-shaped apertures 102A and 102B, which are fanned-out apertures, formed in the electrodes 33 and 34, respectively. The fan-shaped aperture 102A opposes the fan-shaped aperture 102B with the dielectric substrate 32 sandwiched therebetween. The fan-shaped apertures 102A and 102B each have the central angle θ of 180° or more (for example, around 270°) with respect to the central point O. The PDTL 40 is connected to the resonator 102.

Reference numeral 103 denotes an output-stage resonator provided in the dielectric substrate 32. As in the resonator 102, the resonator 103 is composed of fan-shaped apertures 103A and 103B, which are fanned-out apertures, formed in the electrodes 33 and 34, respectively. The fan-shaped aperture 103A opposes the fan-shaped aperture 103B with the dielectric substrate 32 sandwiched therebetween. The PDTL 41 is connected to the resonator 103.

The resonators 102 and 103 are symmetrically arranged with a dual-mode resonator 104 described below sandwiched therebetween. The fan-shaped apertures 102A and 102B and the fan-shaped apertures 103A and 103B fan out with respect to the dual-mode resonator 104. An arc line E of electric force appears in each of the resonators 102 and 103.

Reference numeral 104 denotes an intermediate-stage dual-mode resonator, which is surrounded by the resonators 102 and 103 and which is provided between the resonators 102 and 103. The dual-mode resonator 104 is composed of substantially square apertures 104A and 104B provided in the electrodes 33 and 34, respectively. Chamfers 105 for adjusting the resonant frequency are provided at two corners of each of the substantially square apertures 104A and 104B.

Two lines E1 and E2 of electric force corresponding to the two resonant modes appear in the dual-mode resonator 104. The dual-mode resonator 104 is arranged such that the line E1 of electric force of the dual-mode resonator 104 opposes the line E of electric force of the input-stage resonator 102 and the line E2 of electric force of the dual-mode resonator 104 opposes the line E of electric force of the output-stage resonator 103. Accordingly, the dual-mode resonator 104 is magnetically coupled to the input-stage resonator 102 in one mode and is magnetically coupled to the output-stage resonator 103 in the other mode.

Since the two resonant modes are coupled to each other in the dual-mode resonator 104, the high-frequency signal passing through the input-stage resonator 102 is supplied to the output-stage resonator 103 through the dual-mode resonator 104. Hence, the dielectric filter 101 serves as a bandpass filter.

The line E1 of electric force of the dual-mode resonator 104 opposes the line E of electric force of the output-stage resonator 103, which is one stage away from the dual-mode resonator 104. In addition, the line E2 of electric force of the dual-mode resonator 104 opposes the line E of electric force of the input-stage resonator 102, which is one stage away from the dual-mode resonator 104. Accordingly, the dual-mode resonator 104 is jump-coupled to the output-stage resonator 103 by the magnetic coupling in one mode, and is jump-coupled to the input-stage resonator 102 by the magnetic coupling in the other mode. As a result, the attenuation peak appears at one side of the passband.

Although the dual-mode resonator 104 according to the eighth embodiment has the chamfers at part of the square apertures, the chamfers may be provided at part of, for example, circular apertures.

Approximately the same advantages as in the third embodiment can be achieved in the eight embodiment. Particularly, since the dielectric filter 101 according to the eight embodiment has the structure in which the resonator 102 is composed of the fan-shaped apertures 102A and 102B, the fan-shaped aperture 102A forms a central angle θ of 180° or more with the fan-shaped aperture 102B, the resonator 103 is composed of the fan-shaped apertures 103A and 103B, the fan-shaped aperture 103A forms a central angle θ of 180° or more with the fan-shaped aperture 103B, and the resonators 102 and 103 surround the dual-mode resonator 104, it is possible to surely suppress spread of the current from the resonators 102 and 103 and the dual-mode resonator 104.

Figure 28:
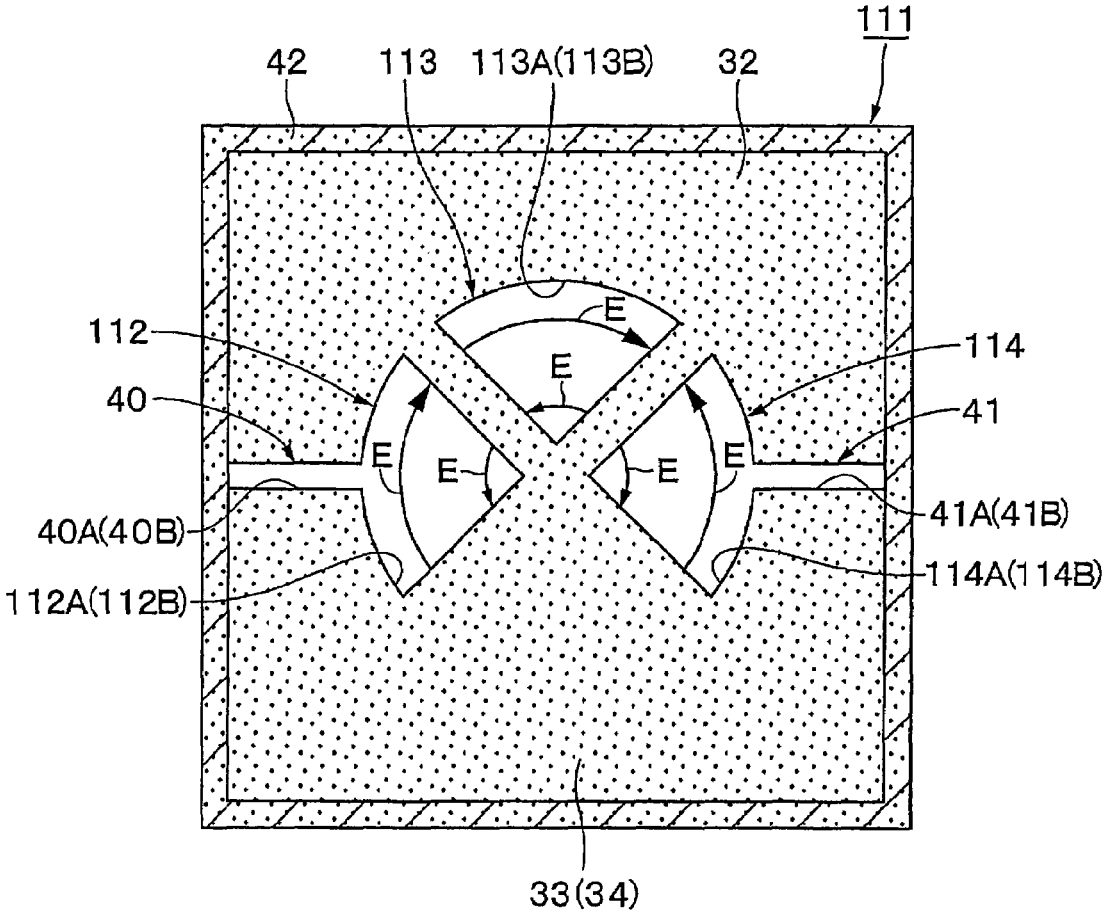
FIG. 28 is a cross-section view of a dielectric filter according to a ninth embodiment, viewed from the same direction as in FIG. 15.

FIG. 28 shows a dielectric filter according to a ninth embodiment of the present invention. The ninth embodiment is characterized in that multiple lines of electric force appear in the fan-shaped apertures of resonators. The same reference numerals are used in the ninth embodiment to identify the same components in the third embodiment. A detailed description of such components is omitted herein.

Reference numeral 111 denotes a dielectric filter according to the ninth embodiment. The dielectric filter 101 includes three resonators 112 to 114 described below.

Reference numerals 112 to 114 denote fan-shaped resonators arranged in an arc, for example, in a substantially C-shaped arc, on the dielectric substrate 32. The resonators 112 to 114 are composed of fan-shaped resonators 112A to 114A and 112B to 114B formed in the electrodes 33 and 34, respectively, as in the resonator 4 according to the first embodiment.

For example, two arc lines E of electric force appear in the respective fan-shaped resonator 112A to 114A and 112B to 114B. Accordingly, each of the resonators 112 to 114 functions similarly to a one-wavelength resonator (multimode resonator).

The resonators 112 to 114 are arranged such that the line E of electric force of the resonator 112 opposes that of the adjoining resonator 113 and the line E of electric force of the resonator 113 opposes that of the adjoining resonator 114. The PDTL 40 is connected to the first-stage resonator 112 and the PDTL 41 is connected to the third-stage resonator 114.

Approximately the same advantages as in the third embodiment can be achieved in the ninth embodiment.

Figure 29:
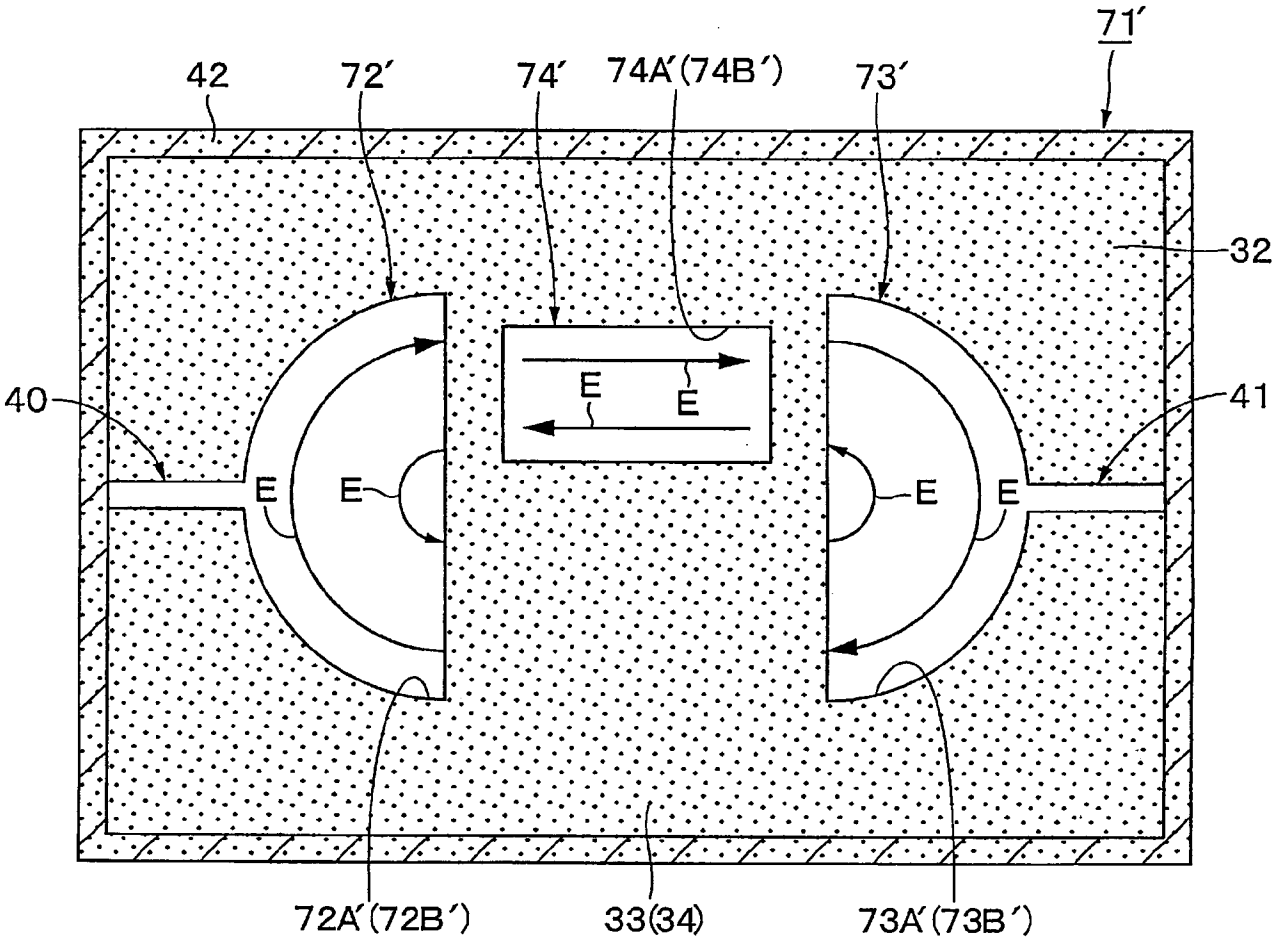
FIG. 29 is a cross-section view of a dielectric filter according to a sixth modification, viewed from the same direction as in FIG. 15.

In addition to the ninth embodiment, as in a sixth modification shown in FIG. 29, resonator 72' to 74' having multiple lines E of electric force in apertures 72A' to 74A' and 72B' to 74B' may be used to form a dielectric filter 71' similar to the dielectric filter 71 in the fifth embodiment.

Figure 30:
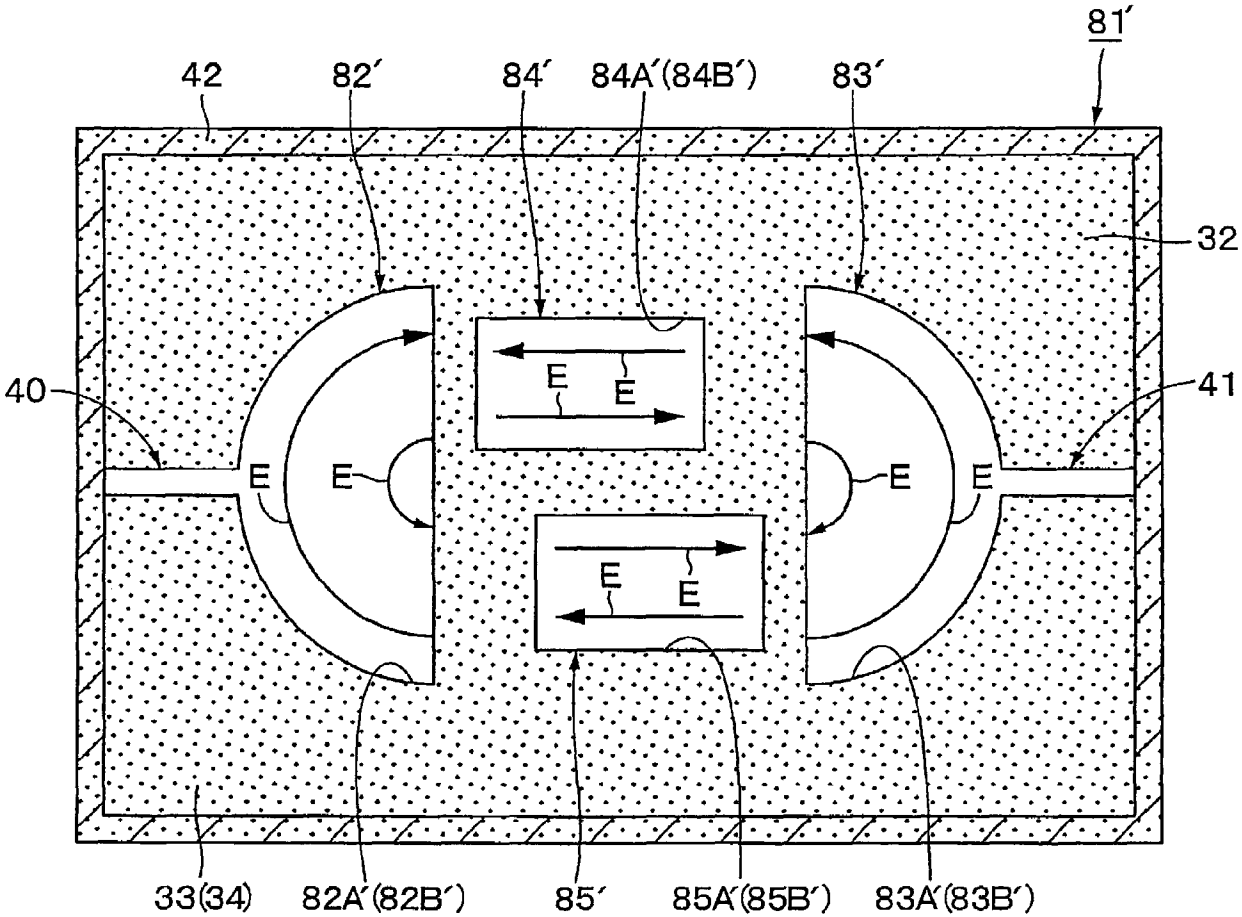
FIG. 30 is a cross-section view of a dielectric filter according to a seventh modification, viewed from the same direction as in FIG. 15.

Alternatively, as in a seventh modification shown in FIG. 30, resonator 82' to 85' having multiple lines E of electric force in apertures 82A' to 85A' and 82B' to 85B' may be used to form a dielectric filter 81' similar to the dielectric filter 81 in the sixth embodiment.

Figure 31:
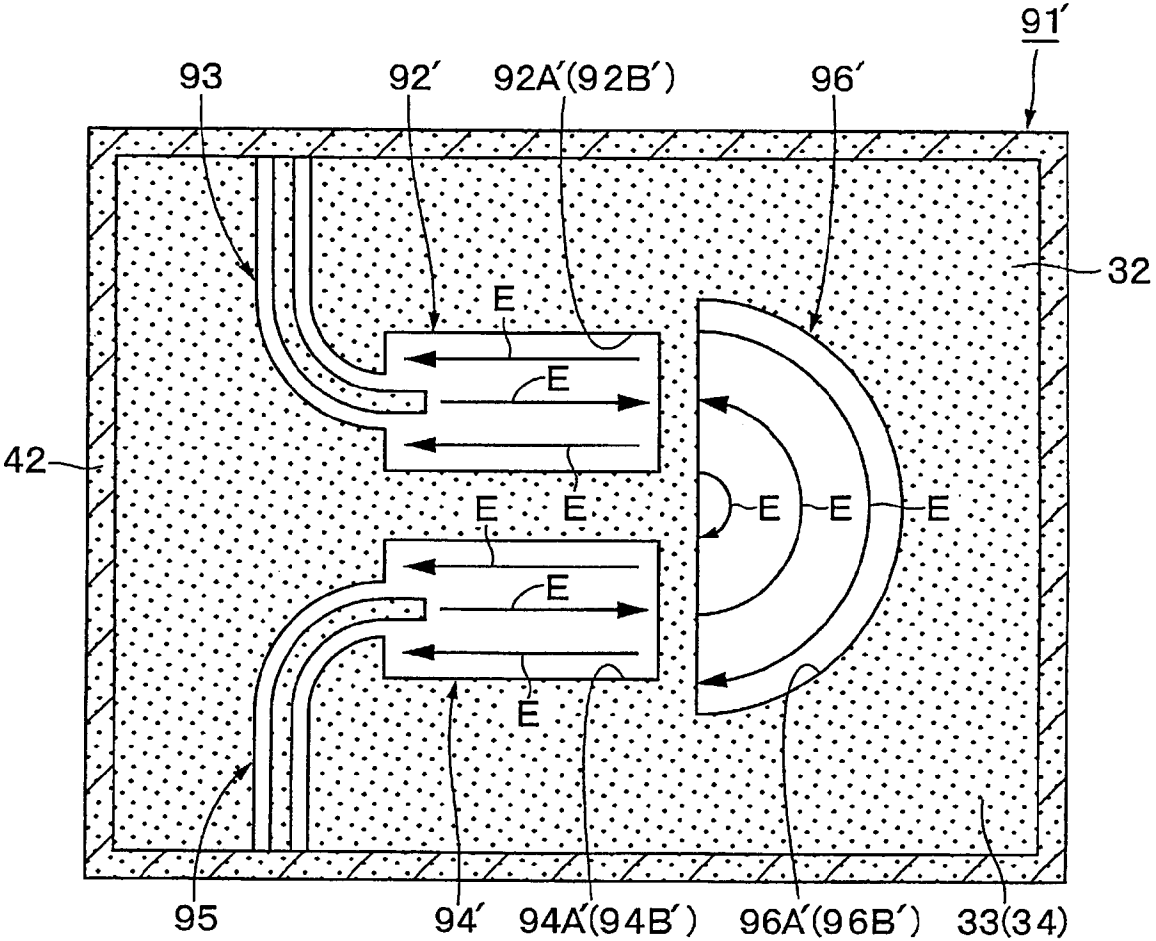
FIG. 31 is a cross-section view of a dielectric filter according to an eighth modification, viewed from the same direction as in FIG. 15.

Alternatively, as in an eighth modification shown in FIG. 31, resonator 92', 94', and 96' having multiple lines E of electric force in apertures 92A', 94A', 96A', 92B', 94B', and 96B' may be used to form a dielectric filter 91' similar to the dielectric filter 91 in the seventh embodiment.

In the eighth modification, since the PDTL resonators 94' and 94' are connected to the coplanar lines 93 and 95, respectively, an odd-number (2n−1) of lines E of electric force appear in the rectangular apertures 92A', 92B', 94A', and 94B'.

Similarly, resonators having multiple lines E of electric force in apertures may be used to form the dielectric filter 61 according to the fourth embodiment and the dielectric filter 101 according to the eighth embodiment.

Figure 32:
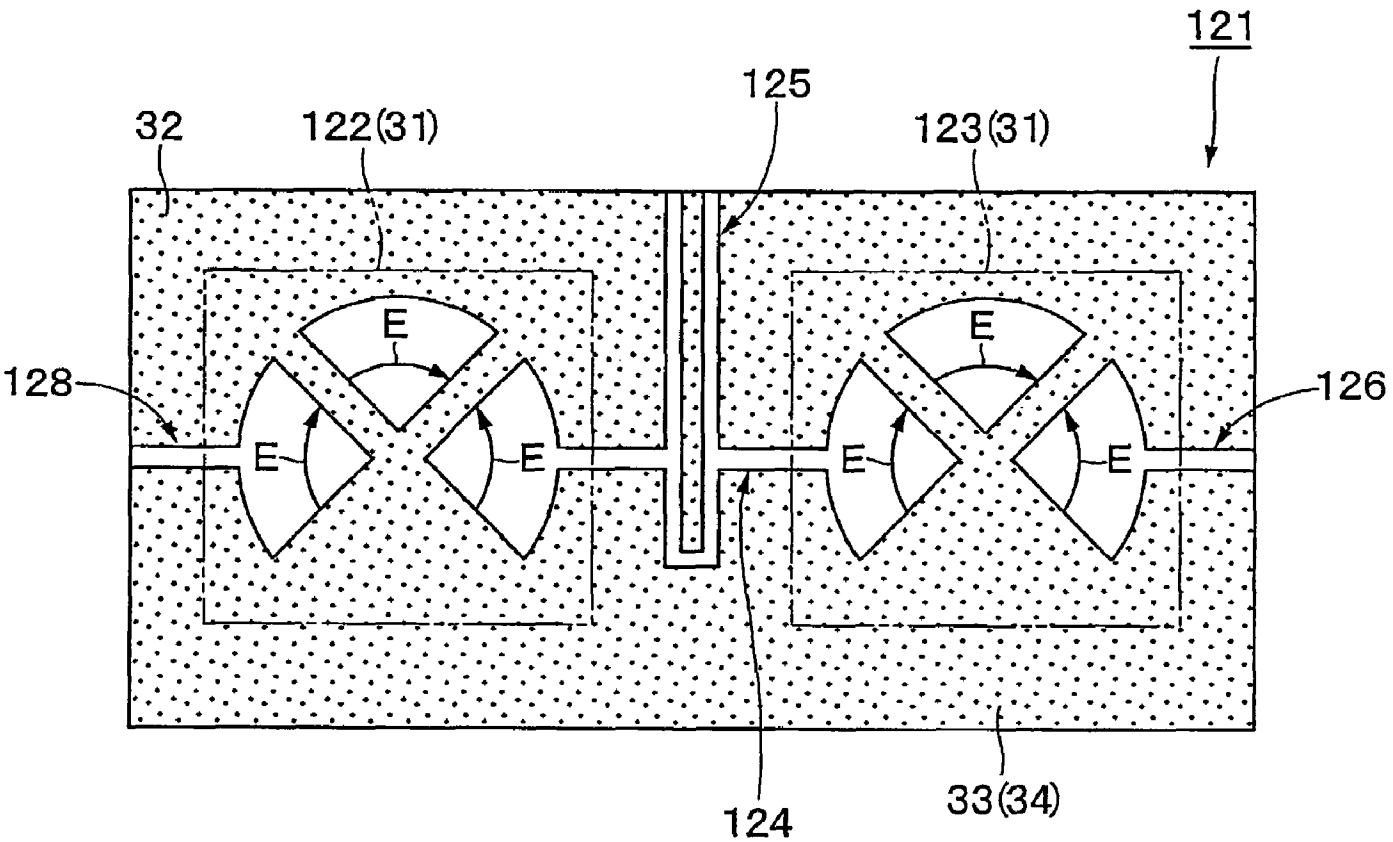
FIG. 32 is a plan view of an antenna duplexer according to a tenth embodiment.
Figure 33:
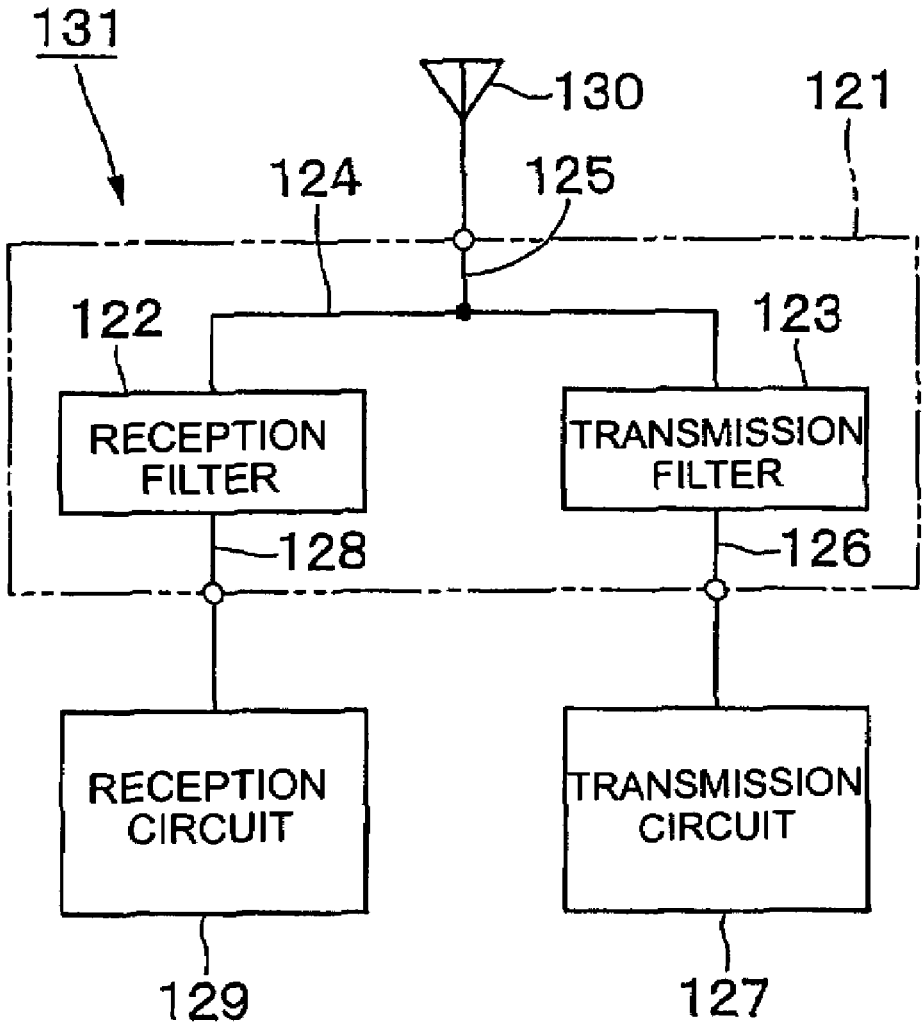
FIG. 33 is a block diagram of a high-frequency communication apparatus according to the tenth embodiment.

FIGS. 32 and 33 show an antenna duplexer and a high-frequency communication apparatus using the duplexer, according to a tenth embodiment of the present invention. The same reference numerals are used in the tenth embodiment to identify the same components in the third embodiment. A detailed description of such components is omitted herein.

Reference numeral 121 denotes an antenna duplexer. The antenna duplexer 121 mainly includes a transmission filter 122 and a reception filter 123 each using, for example, the dielectric filter 31 according to the third embodiment. The transmission filter 122 is connected to the reception filter 123 via a planar dielectric transmission line 124 (hereinafter referred to as the PDTL 124), and a coplanar line 125 for connecting the antenna is connected in the middle of the PDTL 124.

As shown in FIGS. 32 and 33, the input side of the transmission filter 122 is connected to a transmission circuit 127 via a planar dielectric transmission line 126 (hereinafter referred to as the PDTL 126), and the output side of the reception filter 123 is connected to a reception circuit 129 via a planar dielectric transmission line 128 (hereinafter referred to as the PDTL 128). The coplanar line 125 is connected to an antenna 130. The duplexer 121, the transmission circuit 127, the reception circuit 129, and the antenna 130 constitute a high-frequency communication apparatus 131.

Approximately the same advantages as in the third embodiment can be achieved in the tenth embodiment. Particularly, since the dielectric filters 31 (the filters 122 and 123) of the present invention are used to form the antenna duplexer 121 and the high-frequency communication apparatus 131 in the tenth embodiment, the level of isolation can be increased without the effect of the filters 122 and 123 on other devices including the transmission circuit 127 and the reception circuit 129. At the same time, the entire apparatus can be reduced in size and the packing density of the apparatus can be increased.

Although the resonators 35 to 37, 52 to 54, 56 to 58, 62 to 64, 72 to 74, 82 to 85, 92, 94, 96, and 102 to 104 having apertures on both the front face 32A and the rear face 32B of the dielectric substrate 32 are used in the third to tenth embodiments, the present invention is not limited to these structures. For example, a resonator that has an aperture only on the front face 32A of the dielectric substrate 32 and that does not have the electrode 34 on the rear face 32B of the dielectric substrate 32 may be used. Alternatively, a resonator that has an aperture only on the front face 32A of the dielectric substrate 32 and that has the electrode 34 entirely grounded on the rear face 32B of the dielectric substrate 32 may be used.

The invention claimed is:

1. A dielectric resonator device comprising a dielectric substrate having front and rear faces, an electrode on at least the front face of the dielectric substrate, and at a fanned-out aperture forming a resonator in the electrode, wherein a fanned-out aperture is an aperture which has two sides which diverge at an angle with respect to an apex, thereby fanning out with respect to the apex, and an arc line of electric force between the two sides.

2. The dielectric resonator device according to claim 1, wherein the fanned-out aperture has corners and at least one of said corners is chamfered.

3. The dielectric resonator device according to claim 2, having an electrode on the rear face of the dielectric substrate, the rear face electrode having a fanned-out aperture of approximately the same shape as and disposed to oppose the fanned-out aperture on the front face.

4. The dielectric resonator device according to claim 1, having an electrode on the rear face of the dielectric substrate, the rear face electrode having a fanned-out aperture of approximately the same shape as and disposed to oppose the fanned-out aperture on the front face.

5. The dielectric resonator device according to claim 1, wherein at least two lines of electric force appear in the fanned-out aperture.

6. A dielectric filter comprising a dielectric substrate having front and rear faces, an electrode on at least the front face of the dielectric substrate, and a plurality of apertures forming a plurality of resonators coupled to each other in the front face electrode, wherein at least one member of the plurality is a fanned-out aperture, wherein a fanned-out aperture is an aperture which has two sides which diverge at an angle with respect to an apex, thereby fanning out with respect to the apex, and an arc line of electric force between the two sides.

7. The dielectric filter according to claim 6, wherein the first fanned-out aperture has corners and at least one of said corners is chamfered.

8. The dielectric filter according to claim 7, having an electrode on the rear face of the dielectric substrate, the rear face electrode having a fanned-out aperture of approximately the same shape as and disposed to oppose the fanned-out aperture on the front face.

9. The dielectric filter according to claim 6, wherein there are at least two lines of electric force in the fanned-out aperture.

10. The dielectric filter according to claim 6, wherein a line of electric force in a fanned-out aperture and a line of electric force in an aperture adjacent to the fanned-out aperture are opposite to each other.

11. The dielectric filter according to claim 6, wherein at least one of said apertures is rectangular.

12. The dielectric filter according to claim 6, wherein there is more than one non-fanned-out aperture and the lines of electric force in apertures other than the fanned-out apertures are parallel to each other.

13. The dielectric filter according to claim 6, wherein all the apertures of the plurality of resonators are the fanned-out apertures and the apertures are disposed in an arc.

14. The dielectric filter according to claim 6, wherein the resonators are arranged so as to have an input-side resonator and an output-side resonator with at least one resonator therebetween, and wherein the apertures of the input-side and output-side resonators are fanned-out apertures, and the aperture of at least one of said resonators therebetween is rectangular.

15. The dielectric filter according to claim 14, wherein there is more than one rectangular apertures resonators between the input-side fanned-out aperture and the output-side fanned-out aperture, and wherein the lines of electric force in the rectangular apertures are in parallel to each other.

16. The dielectric filter according to claim 6 wherein the resonators are arranged so as to have an input-side resonator and an output-side resonator with at least one resonator therebetween, wherein the input-side and output-side resonators are rectangular apertures, and wherein at least one resonator therebetween is a fanned-out aperture.

17. The dielectric filter according to claim 16, wherein the rectangular input-side and output-side apertures are arranged such that the lines of electric force thereof are parallel to each other.

18. The dielectric filter according to claim 6, wherein the resonators are arranged so as to have an input-side resonator and an output-side resonator with at least one resonator therebetween, and wherein the apertures of the input-side and output-side resonators are fanned-out apertures, and wherein a resonator between the input-side and output-side resonators is a dual-mode resonator.

19. The dielectric filter according to claim 6, wherein the dielectric substrate is disposed in a casing having two conductive faces and the two conductive faces are spaced apart from the front and rear faces of the dielectric substrate and any electrode thereon.

20. The dielectric filter according to claim 6, wherein the fanned-out aperture is an aperture which has two sides which diverge at an angle of at least 180° with respect to the apex.

21. A duplexer utilizing a dielectric filter according to claim 6.

22. A high-frequency communication apparatus utilizing a dielectric filter according to claim 6.

* * * * *